US006742874B2

(12) United States Patent
Hirayama et al.

(10) Patent No.: US 6,742,874 B2
(45) Date of Patent: Jun. 1, 2004

(54) PRINTHEAD SUBSTRATE INPUTTING A DATA SIGNAL AND A CLOCK SIGNAL, PRINTHEAD, PRINTHEAD CARTRIDGE, AND PRINTER THEREOF

(75) Inventors: Nobuyuki Hirayama, Kanagawa (JP); Tatsuo Furukawa, Kanagawa (JP); Yoshiyuki Imanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/163,596

(22) Filed: Jun. 7, 2002

(65) Prior Publication Data

US 2002/0191052 A1 Dec. 19, 2002

(30) Foreign Application Priority Data

Jun. 15, 2001 (JP) ..... 2001-182460

(51) Int. Cl.[7] ..... B41J 2/05
(52) U.S. Cl. ..... 347/57; 347/59
(58) Field of Search ..... 347/12, 13, 914, 347/57–59, 20, 56

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/56 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,519,416 A | * | 5/1996 | Hayasaki et al. | 347/13 |
| 5,988,785 A | | 11/1999 | Katayama | 347/13 |
| 6,116,721 A | | 9/2000 | Higuchi et al. | 347/46 |
| 6,243,111 B1 | | 6/2001 | Imanaka et al. | 347/13 |

FOREIGN PATENT DOCUMENTS

| | | | |
|---|---|---|---|
| EP | 0980758 | 2/2000 | B41J/2/14 |
| EP | 0997279 | 5/2000 | B41J/2/05 |
| EP | 1013423 | 6/2000 | B41J/2/05 |
| JP | 59-123670 | 7/1984 | B41J/3/04 |
| JP | 59-138461 | 8/1984 | B41J/3/04 |

* cited by examiner

*Primary Examiner*—Juanita Stephens
(74) *Attorney, Agent, or Firm*—Fitzpatrick, Cella, Harper & Scinto

(57) ABSTRACT

Printhead substrate for inputting a data signal (DATA) in synchronization with a clock signal (CLK). The printhead substrate comprises: input terminals inputting the clock signal and data signal; shift registers inputting and maintaining the data signal in synchronization with the clock signal inputted from the input terminals; and a time lag adjuster arranged between an input terminal and the shift register to adjust a time lag of at least one of the clock signal or data signal. By virtue of adjusting the time lag by the time lag adjuster, setup time and hold time between the clock signal and the data signal inputted to the shift register is ensured.

20 Claims, 21 Drawing Sheets

PRINTHEAD SUBSTRATE INPUTTING A DATA SIGNAL AND A CLOCK SIGNAL, PRINTHEAD, PRINTHEAD CARTRIDGE, AND PRINTER THEREOF

FIELD OF THE INVENTION

The present invention relates to a printhead substrate for inputting a data signal in synchronization with a clock signal, printhead, printhead cartridge, and printer thereof.

BACKGROUND OF THE INVENTION

FIGS. 1 and 2 show respectively a layout and a circuit diagram of a conventional inkjet printhead for inputting a data signal in synchronization with a clock signal.

Referring to FIG. 1, a printhead substrate (heater board) 100 includes: a heater portion 101 serving as an electrothermal transducer; a driver portion 102 having a transistor for driving the heater portion 101; a latch 103 latching printing data; a shift register 104 storing serially inputted printing data; and a PAD portion 105 serving as an input terminal where various signals are inputted.

FIG. 2 is a circuit diagram of the heater board 100 shown in FIG. 1. Components common to those shown in FIG. 1 are referred to by the same reference numerals. The heater portion 101 includes a plurality of heaters (resisters) and the driver portion 102 has an FET transistor, a buffer circuit for each heater.

FIG. 3 is a view explaining a relation between input waveforms, obtained when the CLK signal and DATA signal driving the circuit shown in FIG. 2 are inputted to the heater board 100, and input waveforms obtained when the CLK signal and DATA signal are inputted to the points A and B of the shift register 104.

Assume herein that the DATA signal is inputted to the shift register 104 in synchronism with two transitional states (leading and trailing edge) of CLK signals, i.e., a state changing from a low level to a high level, and a state changing from a high level to a low level. Note that the DATA signal, sent from a printer main unit employing the printhead, is a high-level or low-level signal for turning on/off a desired heater (heating element). The DATA signal inputted to the PAD portion 105 is sent to the Schmitt circuit 106, then through the buffer circuit 107 connected to the output terminal of the Schmitt circuit 106, inputted to the shift register 104 (point B). Similarly, the CLK signal from the PAD portion 105 is inputted to the Schmitt circuit 106, then through the buffer circuit 107 connected to the output terminal of the Schmitt circuit 106, inputted to the shift register 104 (point A). The DATA signal is inputted to the shift register 104 in synchronization with both transitions of a low level to a high level and a high level to a low level of the CLK signal.

In a case where the number of shift registers 104 provided is one as in a conventional printhead, the number of logic gates from the PAD portion 105 to the shift register 104 is equal in the CLK signal and DATA signal. Furthermore, a load driven by each of the buffer circuits 107 is equal in the CLK signal and DATA signal. Therefore, the time lag of the CLK signal generated between the PAD portion 105 and the point A is equal to the time lag of the DATA signal generated between the PAD portion 105 and the point B. Thus, the temporal relative relation between the CLK signal and DATA signal is equal in the PAD portion 105 and the input portions A and B of the shift register 104. In order to surely input the DATA signal to the shift register 104 without malfunction, the level of the DATA signal needs to be constant before and after the transition of the CLK signal. In other words, the time during which the DATA signal is constant with respect to the CLK signal, i.e., setup time and hold time, must be equal in the input portions A and B of the shift register 104 so as to allow a margin for malfunction and enable high-speed data transfer.

In order to meet the recent demands for high-precision printing quality of a color image, for instance as shown in FIG. 4, a single heater board (head substrate) comprises plural heating elements (heaters) for printing images in plural colors. Furthermore, in keeping with the trend of increasing speed and higher precision in printing, a discharge frequency of the heaters is increased with increasing of the number of heaters. As a result, the amount of data transferred to the printhead per unit time increases. In order to handle the increased amount of data, the transferred data is divided, and the divided plural blocks of data are transferred simultaneously in synchronization with one clock signal. In this case, a plurality of shift registers need to be provided in the printhead in conformity to the plural blocks of data.

In the printhead having a plurality of shift registers, in order to simultaneously input the DATA signal to the plurality of shift registers in synchronization with the clock signal, it is necessary to input a number of CLK signals and DATA signals corresponding to the number of shift registers. However, if a plurality of pads for inputting these signals and corresponding input circuits are provided in the printhead substrate, the layout area necessary for these circuits increases, and as a result, the chip size increases. Furthermore, since the aforementioned substrate is formed on a silicon wafer, the increased chip size causes a decreased number of chips produced from one sheet of wafer, resulting in an increased cost.

In order to avoid the increased chip size, it is necessary to reduce the number of signal lines inputted to the heater board. To realize this, the CLK signal serving as a common synchronization signal for the plural shift registers 401 to 406 is provided as a common signal so that, for instance, only one input pad is necessary for the CLK signal as shown in FIG. 5. In this case, while plural shift registers 401 to 406 are connected to the output of the buffer circuit 500 of the CLK signal, only one shift register is connected to each output of the buffer circuit 501 of the DATA signal. Assuming that a current driving capability of the buffer circuit 500 is equal to that of the buffer circuit 501, a difference is generated between a time lag of the CLK signal and a time lag of the DATA signal inputted to each shift register. More specifically, there is more delay in the CLK signal than the DATA signal. When a power-supply voltage is 5V as in a conventional case, the time lag of the signal is small since the current driving capability of the buffer circuit 500 is sufficient. Therefore, the difference between the time lag of the CLK signal and the time lag of the DATA signal is small in each shift register.

For an interface of a conventional printer, a parallel interface has been employed in general. In this case, a power-supply voltage used for the logic of the printer main unit is 5V. Also, a power-supply voltage for the logic of an inkjet printhead substrate in the head is 5V. Furthermore, a part of an IC of the printer's internal circuit requires a 5V power supply. These are the background of the feature of the inkjet printhead substrate, which has been developed to use a 5V logic power supply.

However, recently as the microtechnology of an IC design rule has improved and a new interface has been employed, adopting a 5V logic power supply is disadvantageous in terms of cost and size. In view of this, adopting 3.3V is the recent movement in the mainstream of a logic power supply of a printer main unit. However, it has been confirmed that several problems occur if a logic power-supply voltage in a head substrate is lowered from the time-proven 5V to 3.3V. The problems are described below with reference to drawings.

One of the problems is reduced image data transfer capability of an inkjet printhead substrate.

FIG. 18 shows an example of a construction of an inkjet printhead substrate. Reference numeral 1003 denotes a pad receiving a signal from an external unit. A VDD terminal 1006 receives a logic power-supply voltage, a VH terminal 1008 receiving a heater driving power-supply voltage, a GND terminal 1005 connected to a ground, and a VSS terminal 1007. Furthermore, a logic circuit 1002, such as a shift register, which serially receives image data and outputs the image data in parallel, a driver portion 1001 driving each heater 1004 and so on are provided in one silicon substrate.

FIG. 19 shows further in detail a case where the heaters 1004 are provided for 620 dots (bits). The heaters for 620 bits are divided into 16 blocks, each for 40 bits. The heaters for up to 40 bits are driven simultaneously in block unit. By repeating the driving of the heaters for 16 times, all the heaters for 620 bits are driven (correspond to 1 cycle). FIG. 20 shows driving timing of the heaters. Hereinafter a description is provided on image data transfer speed necessary to drive all the heaters for 620 bits at a driving frequency of 15 KHz that is required for one line unit, in a case where constant high-speed printing is performed.

A clock cycle of the driving frequency 15 KHz is 66.67 $\mu$s. The 40-bit image data transfer must be performed for 16 time divisions (blocks) within the given time. A frequency necessary for the CLK signal, which transfers the image data signal DATA, is at least 12 MHz or more. Although this frequency is not much of a fast value taking a process speed of a general CPU into consideration, in the case of an inkjet printhead, 12 MHz is not easy to achieve because a running carriage and a main body are connected with a long flexible substrate or the like and there is a need for a small carriage due to downsizing of a printer.

Keeping these circumstances in mind, a description is now provided with reference to FIGS. 21A and 21B on a reduced data transfer capability in a case where the logic power-supply voltage is lowered from 5V to 3.3V.

FIG. 21A shows a logic signal (power supply) voltage and a maximum CLK frequency at which image data is transferable.

As shown in FIG. 21A, as the logic signal (power-supply) voltage decreases, the CLK frequency tends to decrease. This is due to the fact that the decreased logic power-supply voltage used as a gate voltage of a CMOS causes a decline in the driving capability of a MOS transistor employed in the shift register or the input circuit of the CLK or the like for transferring image data.

Furthermore, in the inkjet printhead substrate, the heaters on the substrate must be driven to achieve satisfactory speed while taking the temperature into consideration. This is a capability characteristically required for an inkjet printhead substrate, which discharges ink by heating ink with heaters. FIG. 21B shows a relation between a temperature on a substrate and maximum CLK frequency. The graph shows the tendency of reduction in data transfer capability as the logic voltage is lowered to 3.3V, and tendency of reduction in data transfer capability as the temperature rises.

As can be understood from the above description, although 5V logic voltage has caused no problem at 12 MHz CLK frequency, lowering the logic voltage to 3.3V requires an increased data transfer capability.

Next, a description is provided on factors of the reduced data transfer capability caused by an enlarged difference between a time lag of the CLK signal and a time lag of the DATA signal in the head substrate due to the aforementioned lowered logic voltage.

Along with the lowered logic voltage, a gate voltage driving the MOS transistor constructing the logic circuit also declines. FIG. 6 shows how a drain current (Id) depends upon a drain-source voltage (Vds) when a gate voltage Vgs of the MOS transistor is used as a parameter. As is apparent from FIG. 6, when the gate voltage Vgs is lowered from 5V to 3.3V, the current driving capability becomes ½ or lower.

Furthermore, in a case where a CMOS inverter drives the gate of the MOS transistor, it can be said that a load corresponding to a capacitance of an equivalently driving gate is given to an output of the inverter as shown in FIG. 7. Assuming that an on-resistance of the MOS is RMOS and an equivalent load capacitance is Cgate, a time constant from the time an input of the inverter changes till the time an output of the MOS transistor is inverted is expressed by Cgate×RMOS. If the load is unchanged and the value of RMOS becomes doubled or higher due to the lowered voltage, the time constant also becomes twice as high or higher.

Referring back to FIG. 4, assume that a capacitance of an input of the CLK signal is equal (CL) to a capacitance of an input signal of the DATA signal in one shift register, an on-resistance at the time of driving the buffer circuit 500 is RBUF, and the number of shift registers is n. The time lag generated between the signal input in the buffer circuit and signal input in the shift register is proportional to (CL×RBUF) in the DATA signal, while it is proportional to (n×CL×RBUF) in the CLK signal. Furthermore, because the time lags of the DATA signal and CLK signal become n times as long and the on-resistance value at the time of driving the buffer circuit becomes doubled due to the lowered logic power-supply voltage, the difference in the time lag is twice as much as the conventional difference. Therefore, the time lag cannot be disregarded.

FIG. 8 shows signal waveforms in a case the CLK signal is delayed with respect to the DATA signal in the input of each shift register. The upper side of FIG. 8 shows waveforms of respective signals inputted to the input pad, and the lower side of FIG. 8 shows waveforms of signals inputted to each shift register. While the setup time and hold time, serving as a margin of the DATA signal with respect to the CLK signal in the input pad are substantially equal in the upper side of FIG. 8, in the input portion of the shift register, the margin of a time difference (hold time) 801 between the transition timing of the CLK signal and changing timing of the DATA signal is reduced because the time lag of the CLK signal is larger than the time lag of the DATA signal.

In the above-described manner, because the margin of the setup time or hold time at the time of shift register input is reduced, it becomes difficult to ensure inputting of a data signal to the shift register. This becomes the cause of malfunction, and makes it difficult to realize high-speed data transfer with an increased frequency of CLK signal.

Furthermore, although the above descriptions have been provided on a case of a printhead substrate having plural shift registers, along with the tendency to have a multi-bit printhead and a reduced chip size, wirings for the DATA signal and CLK signal tend to be longer inside the chip. As a result, a parasitic capacitance and resistance value in wirings of the CLK signal and DATA signal increase, causing a large difference in the parasitic components in the wirings of the DATA signal and CLK signal. Even if the number of shift registers connected to the DATA signal and CLK signal is equal, when the parasitic capacitance and resistance value in the wirings of the output of the buffer are different in the DATA signal and CLK signal, a large difference is generated between the time lag of the DATA signal and the time lag of the CLK signal inputted to each shift register due to the lowered power-supply voltage, as similar to the above-described case. This becomes the cause of malfunction and interferes with high-speed data transfer.

SUMMARY OF THE INVENTION

The present invention has been proposed in view of the above-described conventional examples, and has as its object to reduce a difference between a time lag of a data signal and a time lag of a clock signal, which is caused by a lowered voltage of a logic power-supply, in order to ensure setup time and hold time of the clock signal and data signal inputted to each register, thereby providing a printhead substrate, printhead, printhead cartridge, and printer, accommodated to high-speed data transfer without increasing a manufacturing cost.

In order to attain the above described objects, a printhead substrate of the present invention comprises the structure as follows:

A printhead substrate inputting a data signal in synchronization with a clock signal, comprises: a plurality of printing elements; input terminals adapted to input the clock signal and data signal; a register adapted to input the clock signal and data signal inputted from said input terminals, and maintain the data signal in synchronization with the clock signal; a time lag adjusting circuit adapted to be arranged between at least one of said input terminals and an input terminal of said register to adjust a time lag of at least one of the clock signal or data signal; and a driver circuit adapted to drive said plurality of printing elements based on the data signal, wherein adjusting the time lag by said time lag adjusting circuit ensures setup time and hold time between the clock signal and the data signal inputted to said register from the input terminals.

In order to attain the above described objects, a printhead of the present invention comprises the structure as follows:

A printhead comprising: a plurality of printing elements; input terminals adapted to input a clock signal and a data signal; a register adapted to input the clock signal and data signal inputted from said input terminals, and maintain the data signal in synchronization with the clock signal; a time lag adjusting circuit adapted to be arranged between at least one of the input terminals and an input terminal of said register to adjust a time lag of at least one of the clock signal or data signal; and a driver circuit adapted to drive said plurality of printing elements based on the data signal, wherein adjusting the time lag by said time lag adjusting circuit ensures setup time and hold time between the clock signal and the data signal inputted to said register from the input terminals.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

[First Embodiment]

Figure 2:
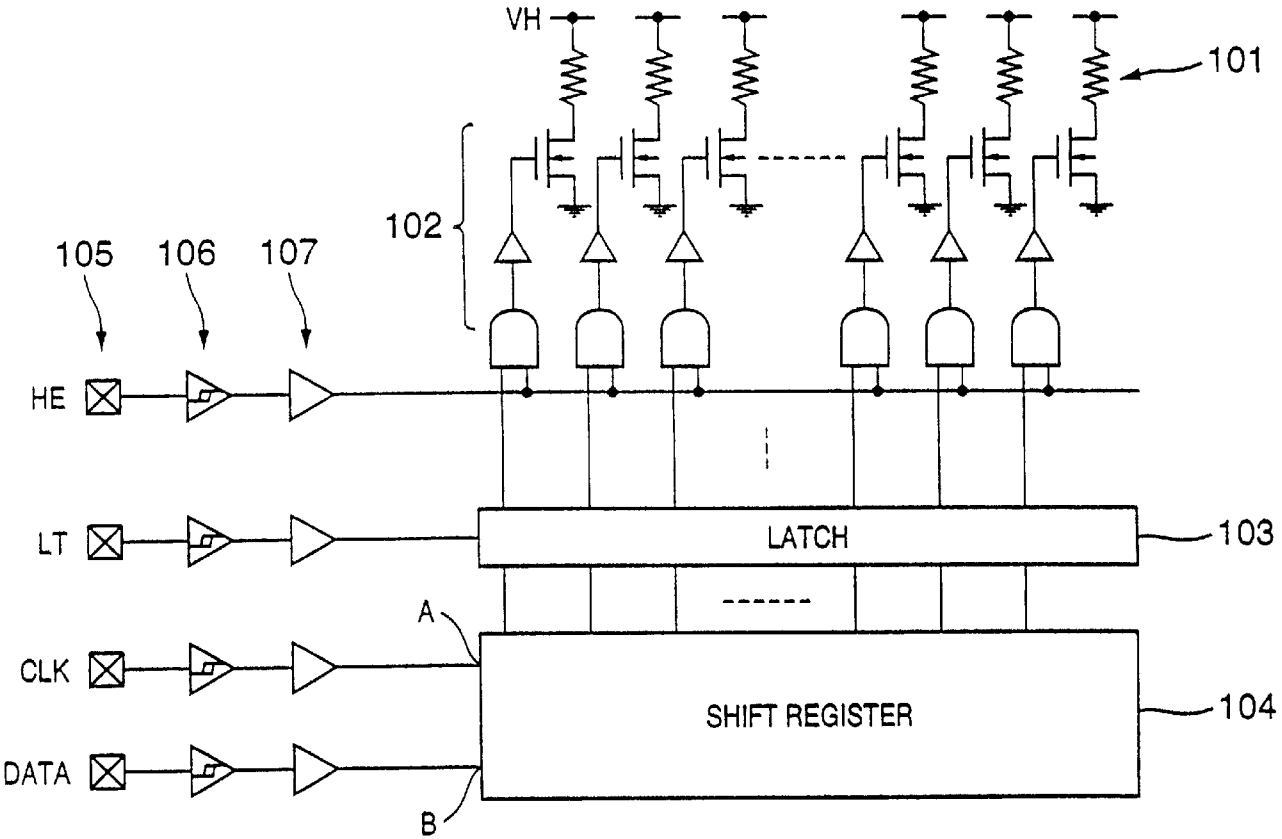
PRIOR ART FIG. 2
FIG. 2 is an example of a circuit diagram of the conventional inkjet printhead for inputting a data signal in synchronization with a clock signal.
Figure 3:
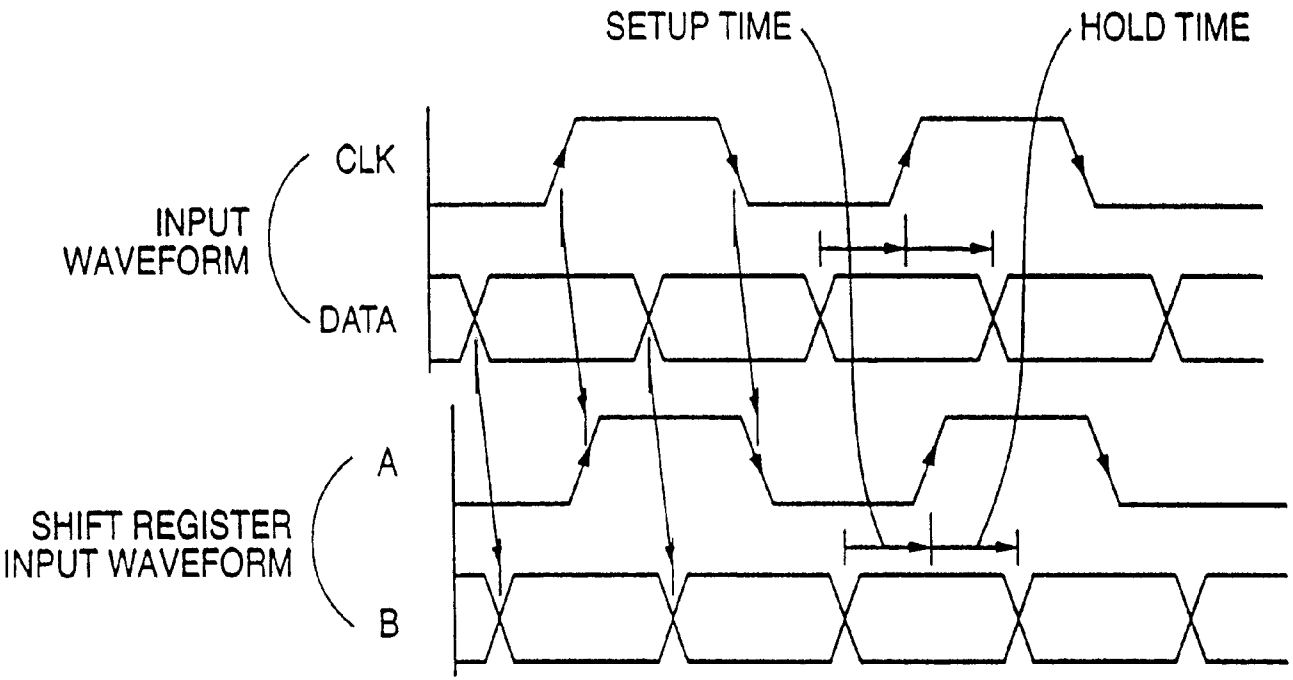
PRIOR ART FIG. 3
FIG. 3 is an explanatory view showing a relation between the CLK signal and DATA signal driving the circuit shown in FIG. 2.
Figure 4:
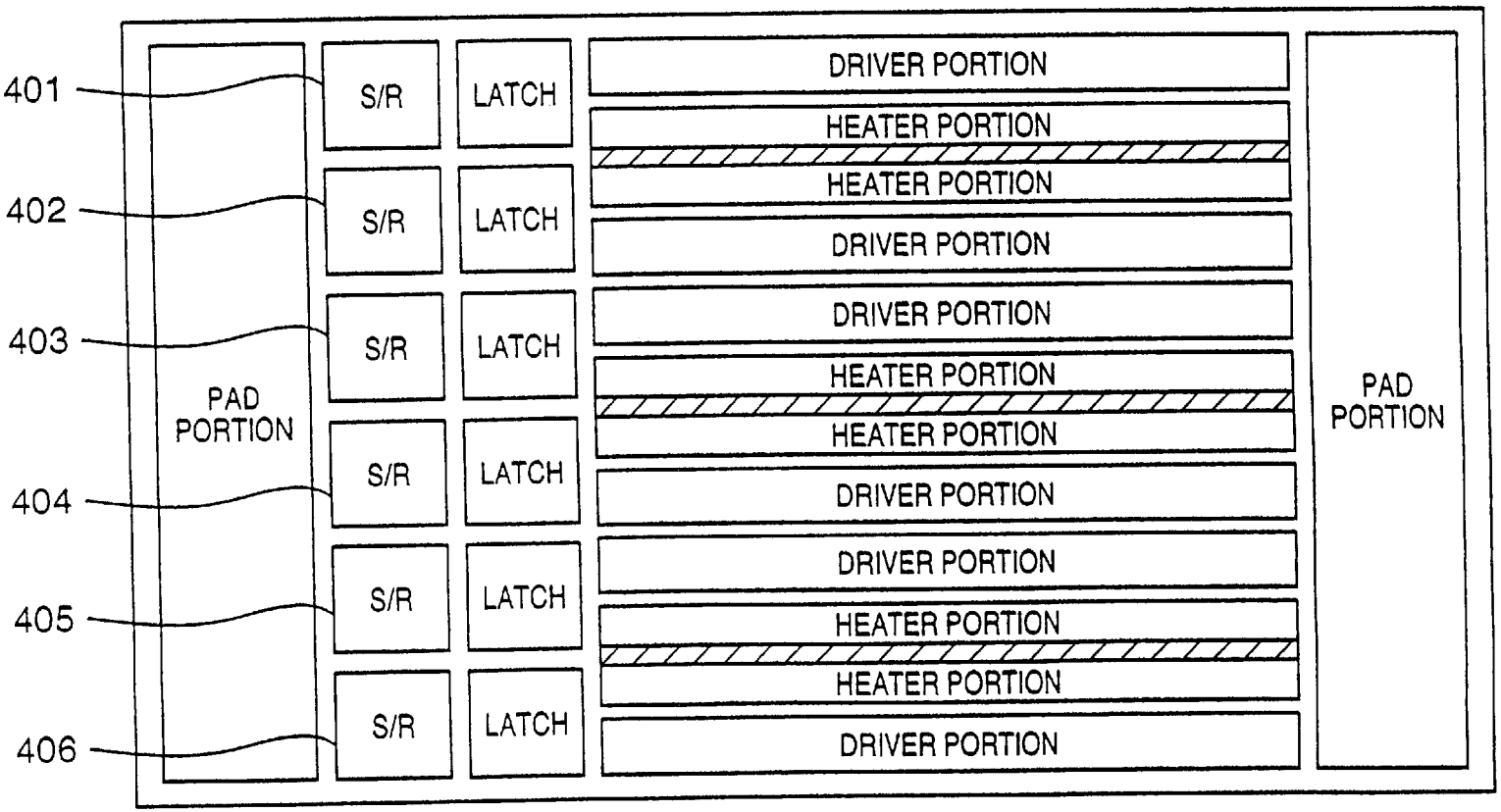
PRIOR ART FIG. 4
FIG. 4 is an explanatory view showing a construction of a conventional printhead substrate.
Figure 5:
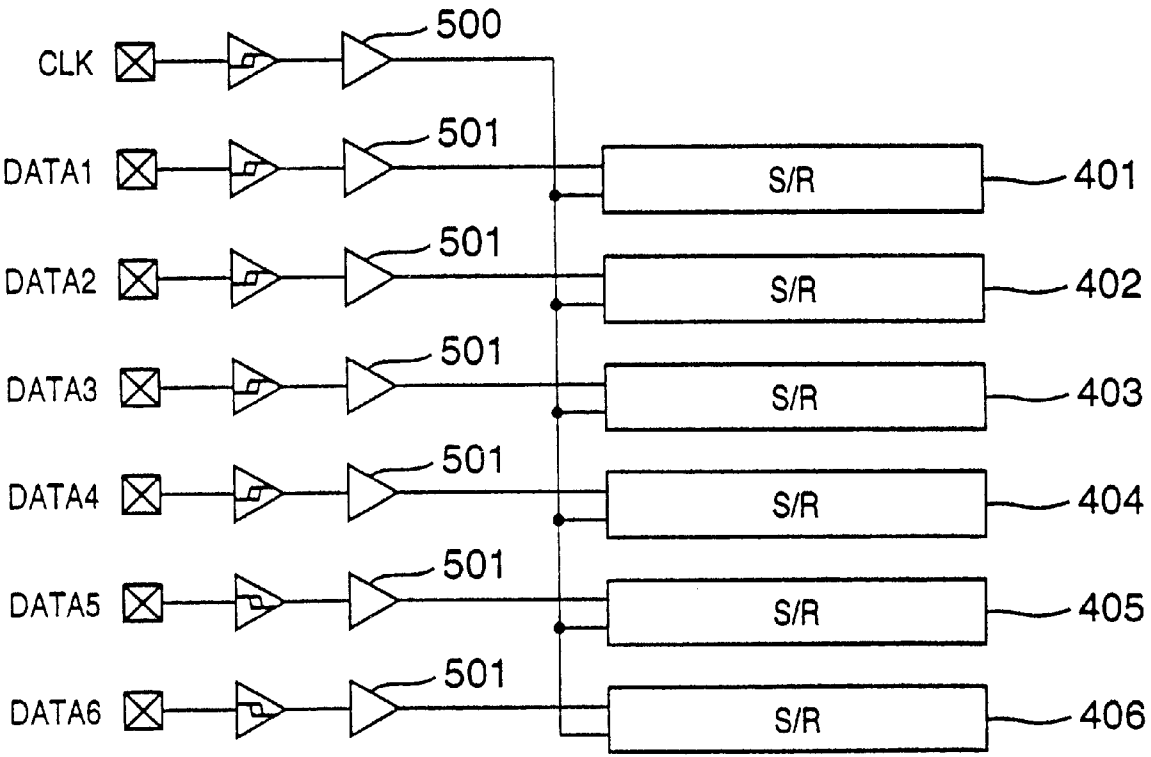
PRIOR ART FIG. 5
FIG. 5 is an explanatory view showing input circuits of the CLK signal and DATA signal inputted to shift registers in the conventional printhead substrate.
Figure 6:
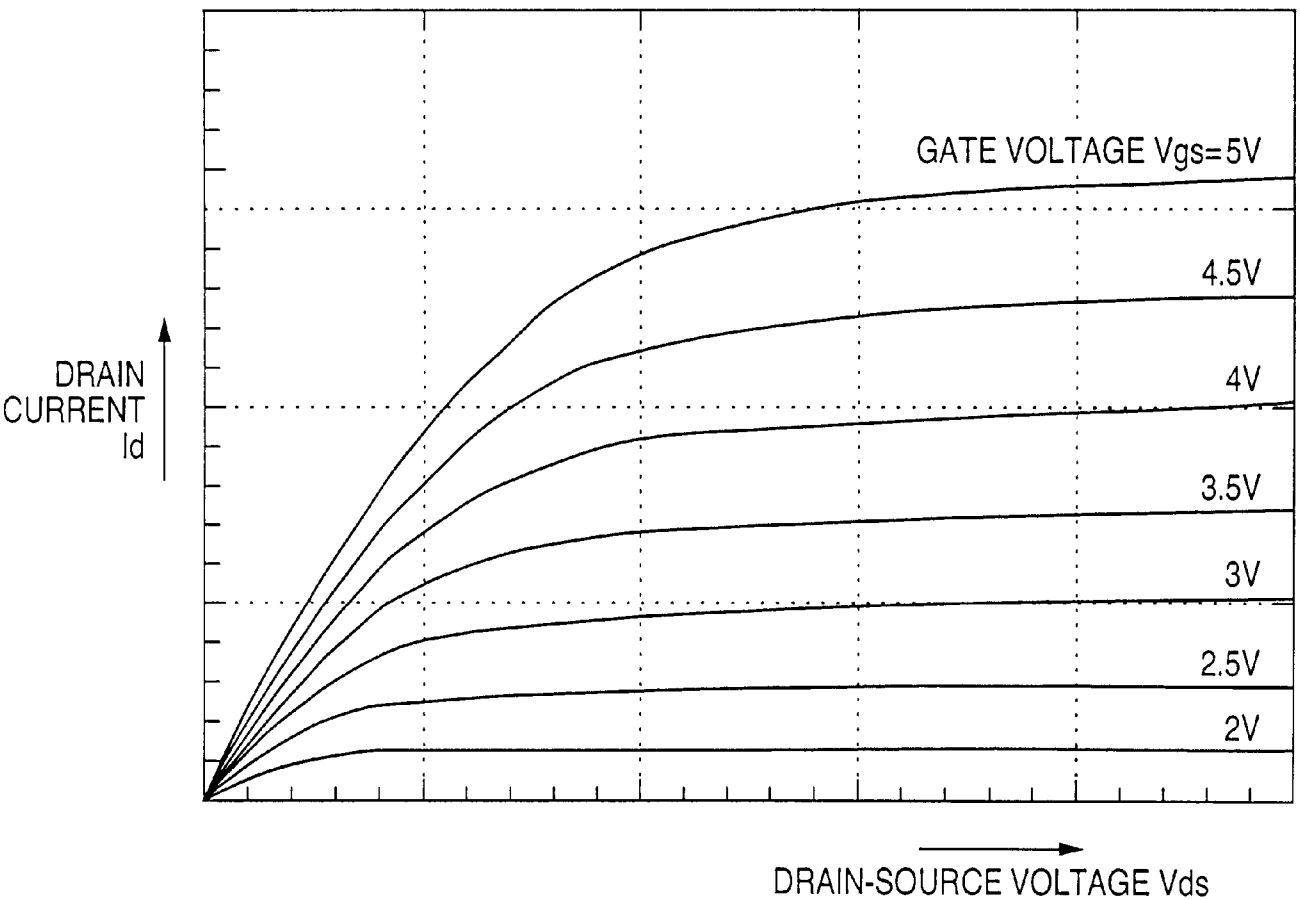
FIG. 6 is a graph explaining how a drain current (Id) depends upon a drain-source voltage (Vds) when a gate voltage of a MOS transistor is used as a parameter.
Figure 7:
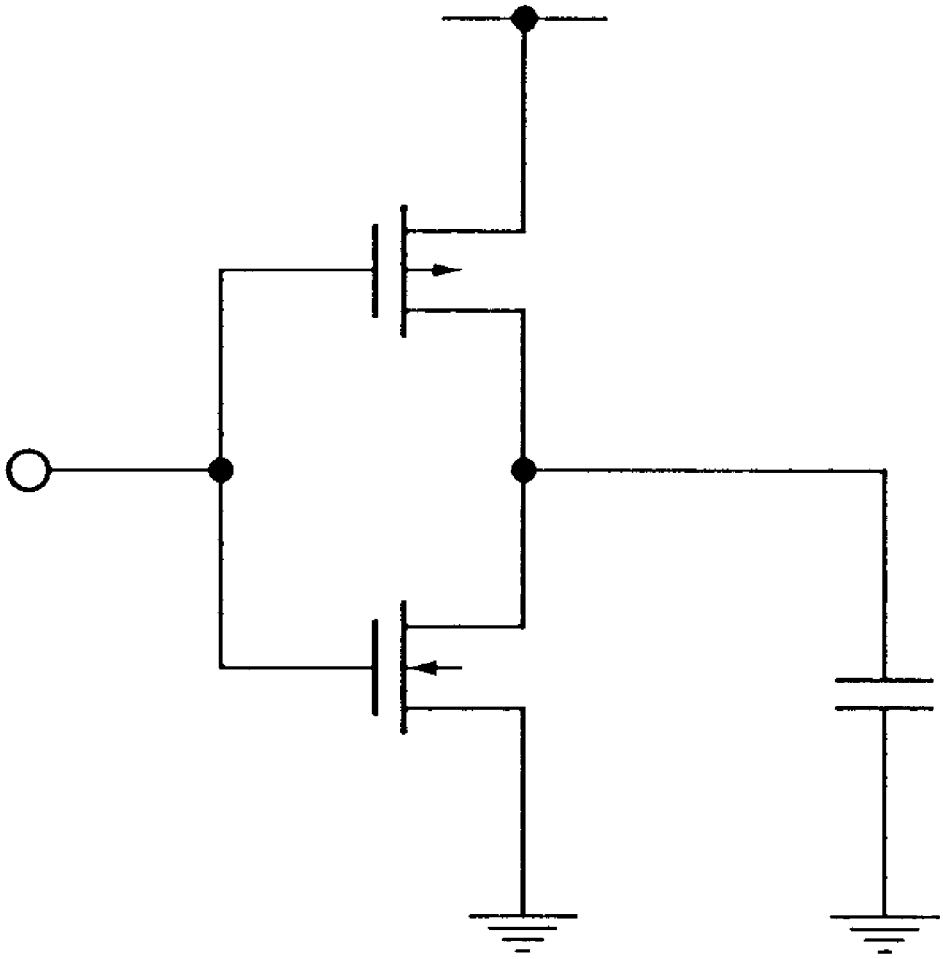
FIG. 7 is an explanatory view of MOS transistor gates.
Figure 9:
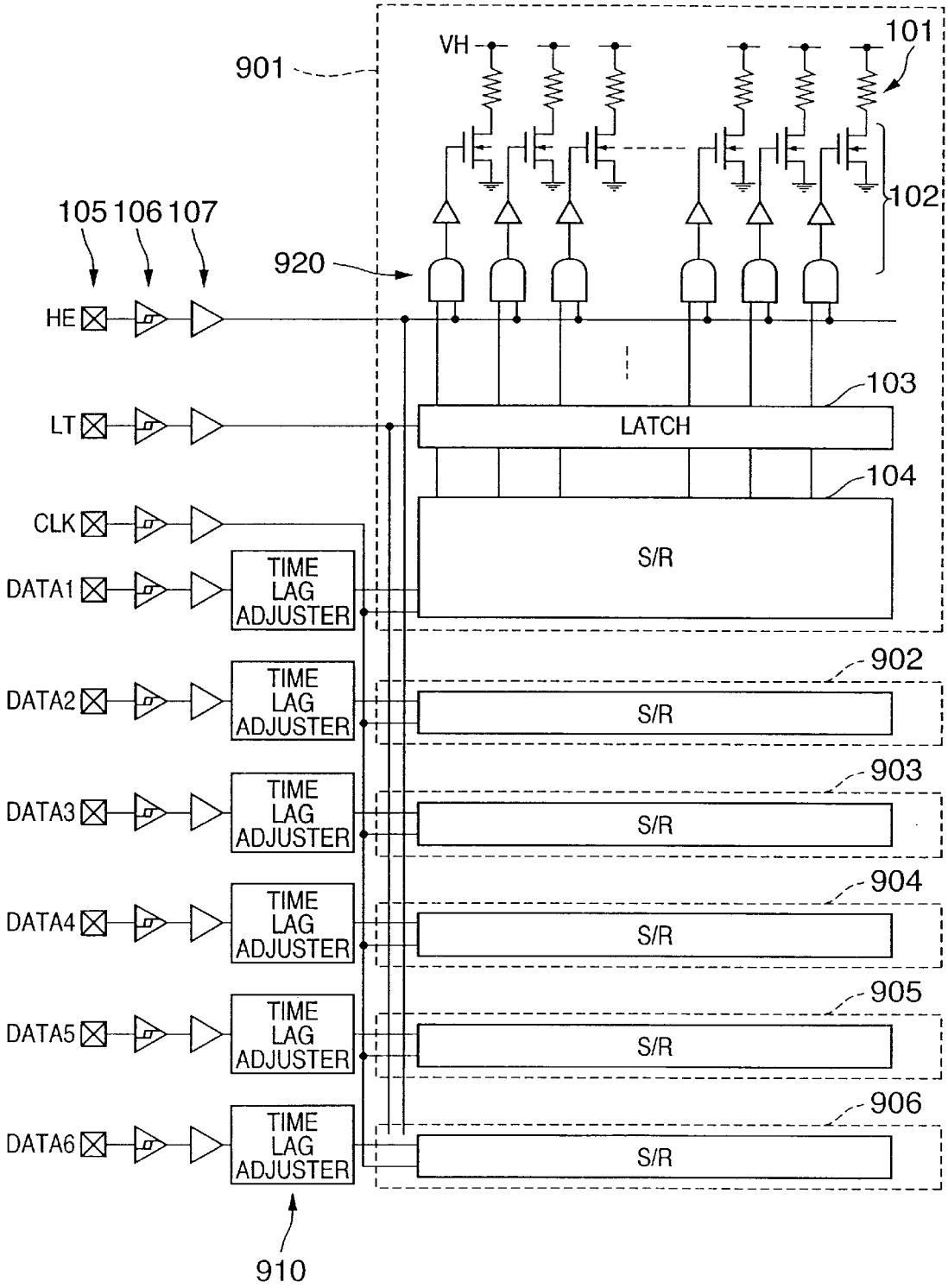
FIG. 9 is a block diagram showing a construction of a printhead substrate according to an embodiment of the present invention.

FIG. 9 is a block diagram showing a construction of a printhead substrate according to the first embodiment of the present invention. Components that are common to those shown in FIG. 2 are referred to by the same reference numerals.

Figure 1:
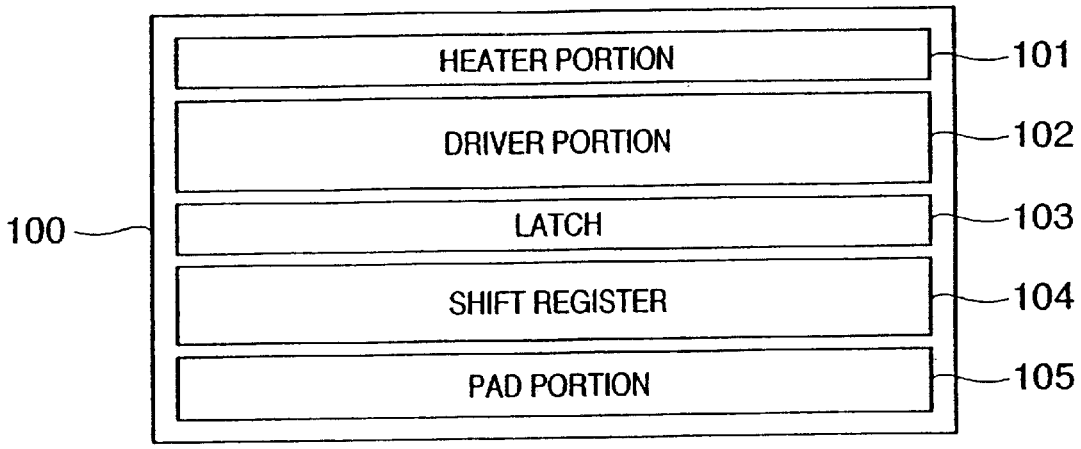
PRIOR ART FIG. 1
FIG. 1 is a view showing a layout of a conventional inkjet printhead for inputting a data signal in synchronization with a clock signal.

Each of the printhead substrates 901 to 906 has the same circuit arrangement as that of the printhead substrate shown in FIG. 1. Assume that printing is performed by using these six sheets of substrates 901 to 906.

In FIG. 9, reference numeral 101 denotes a heater portion (heater element) serving as an electrothermal transducer, numeral 102 denotes a driver portion driving each heater element in accordance with printing data, numeral 103 denotes a latch circuit latching printing data, numeral 104 denotes a shift register storing and maintaining a DATA signal serially inputted in synchronization with a CLK signal, and numeral 920 denotes AND circuits driving the driver portion 102 in accordance with printing data to heat the heater portion 101 while a heat enable signal HE, which will be described later with reference to an AND circuit, is HIGH. The foregoing components are integrally formed on a semiconductor substrate, made of silicon or the like, by a semiconductor manufacturing process, such as a deposition process or the like. Since substrates 902 to 906 have the same construction as that of the substrate 901, detailed description thereof is omitted. Note in the following embodiments, the term "on the substrate" means not only the top surface of a substrate made of silicon or the like, but also an inner portion of the substrate in the neighborhood of the surface of the substrate.

On the above-described substrate, an ink discharge orifice and a member (not shown) forming a liquid path connected to the ink discharge orifice are provided corresponding to each heater element (printing element) 101, thereby constructing a printhead. Ink supplied to the heater element is heated by driving the heater elements 101 to cause film boiling which generate bubbles in the ink, and ink is discharged from the discharge orifice (nozzle).

Reference numeral 105 denotes an input pad portion, numeral 106 denotes a hysteresis circuit, and numeral 107 denotes a buffer circuit. Reference numeral 910 denotes a time lag adjuster, provided as the characteristic component of the first embodiment, which delays each DATA signal by a predetermined time period with respect to a CLK signal. By delaying the DATA signal, the time lag adjuster 910 compensates the reduced margin, caused by a delayed clock signal CLK indicated by 801 in FIG. 8.

A signal HE denotes a heat enable signal, which defines electrification time of each heater element 101. When the signal HE is high, an input to the AND circuit 920 is enabled, and the corresponding driver circuit 102 is driven in accordance with printing data from the latch circuit 103 to apply an electric current to the corresponding heater element 101. A signal LT denotes a latch signal, which causes the latch circuit 103 to input and latch data stored in the shift register 104. Both signals HE and LT are respectively inputted to printhead substrates 901 to 906.

Figure 8:
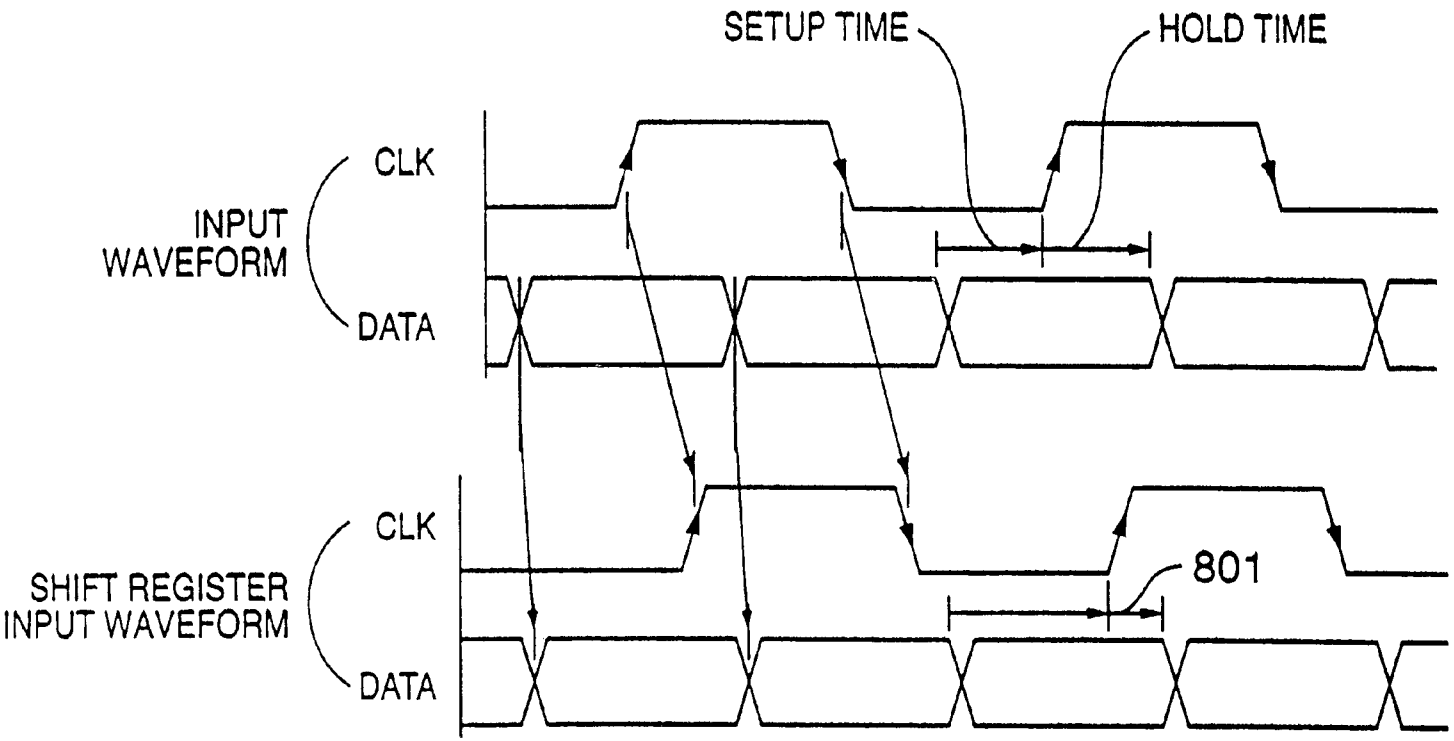
PRIOR ART FIG. 8
FIG. 8 is a view explaining conventional problems.

According to the above-described first embodiment, the time lag of the CLK signal is made substantially equal to the time lag of the DATA signal. Accordingly, the problem caused by a reduced margin shown in FIG. 8 is solved.

Note although the first embodiment has described a case where the DATA signal is delayed with respect to the CLK signal, the present invention is not limited to this case. A driving capability of a CLK signal may be increased, or a component corresponding to the time lag adjuster may be provided for both DATA signal and CLK signal so as to consequently equalize the time lags of the DATA signal and CLK signal inputted to each shift register.

[Second Embodiment]

Figure 10:
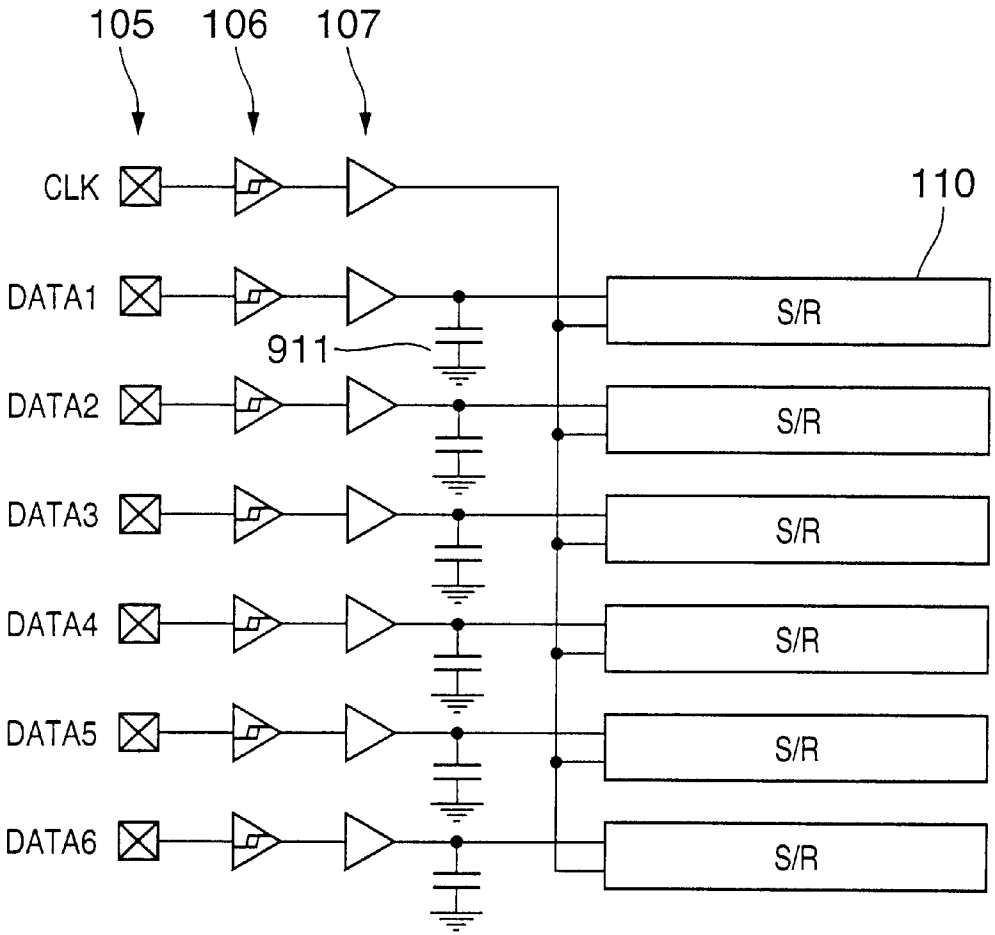
FIG. 10 is a circuit diagram showing wirings of DATA signal and CLK signal on a printhead substrate according to a second embodiment of the present invention.

FIG. 10 is a circuit diagram showing wirings of DATA signal and CLK signal on a printhead substrate according to the second embodiment of the present invention. Components that are common to those shown in FIG. 9 are referred to by the same reference numerals, and descriptions thereof are omitted.

FIG. 10 shows that a capacitor (condenser) 911 is connected to each output of the buffer 107 of each DATA signal, as an example of the time lag adjuster 910. Herein, assume that a capacitance of each condenser 911 is CL, and input capacitances at the DATA input terminal and CLK input terminal of each shift register 110 are CDATA and CCLK respectively. Further assume that on-resistances of the DATA signal and CLK signal at the time of driving the buffer circuit 107 are RDATA and RCLK respectively, and the number of shift registers 110 commonly connected to the CLK signal is n. Herein, a time lag TDATA of the DATA signal and a time lag TCLK of the CLK signal inputted to each shift register 110 are described as follows:

$$TDATA \approx RDATA \times (CDATA + CL)$$

$$TCLK \approx n \times RCLK \times CCLK$$

Herein, CL is set as follows:

$$CL = (n \times RCLK \times CCLK)/RDATA - CDATA$$

As a result, TDATA=TCLK stands. By virtue of this, a difference between the time lag of the DATA signal and the time lag of the CLK signal inputted to each shift register 110 can be eliminated.

[Third Embodiment]

Figure 11:
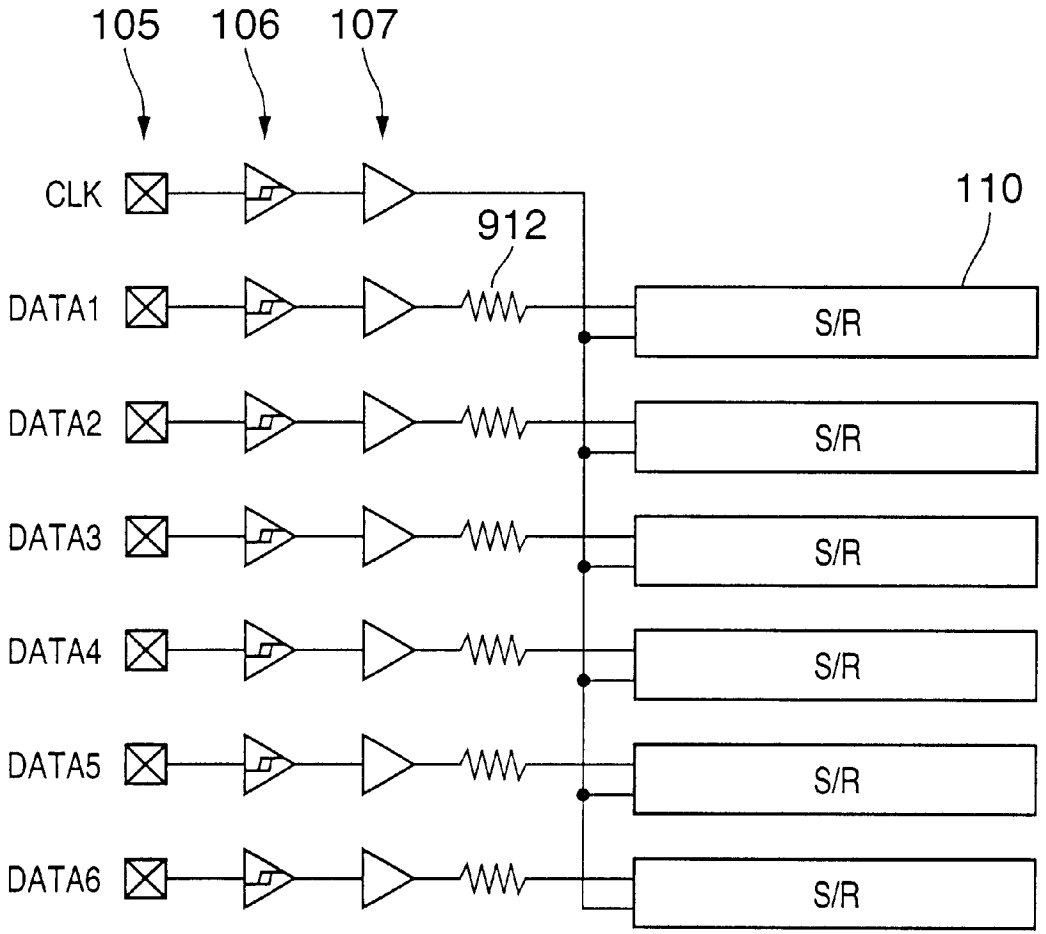
FIG. 11 is a circuit diagram showing wirings of DATA signal and CLK signal on a printhead substrate according to a third embodiment of the present invention.

FIG. 11 is a circuit diagram showing wirings of DATA signal and CLK signal on a printhead substrate according to the third embodiment of the present invention. Components that are common to those shown in FIGS. 9 and 10 are referred to by the same reference numerals, and descriptions thereof are omitted.

FIG. 11 shows that a resistance 912 is connected to each output of the buffer circuit 107 of each DATA signal, as an example of the time lag adjuster 910. Assume that a resistance value of each resistance 912 is RL, the time lag TDATA of the DATA signal and the time lag TCLK of the CLK signal inputted to each shift register are described as follows:

$$TDATA \approx (RDATA + RL) \times CDATA$$

$$TCLK \approx n \times RCLK \times CCLK$$

Herein, the resistance value RL is set as follows:

$$RL = (n \times RCLK \times CCLK)/CDATA - RDATA$$

As a result, TDATA=TCLK stands. By virtue of this, a difference between the time lag of the DATA signal and the time lag of the CLK signal inputted to each shift register 110 can be eliminated.

[Fourth Embodiment]

Figure 12:
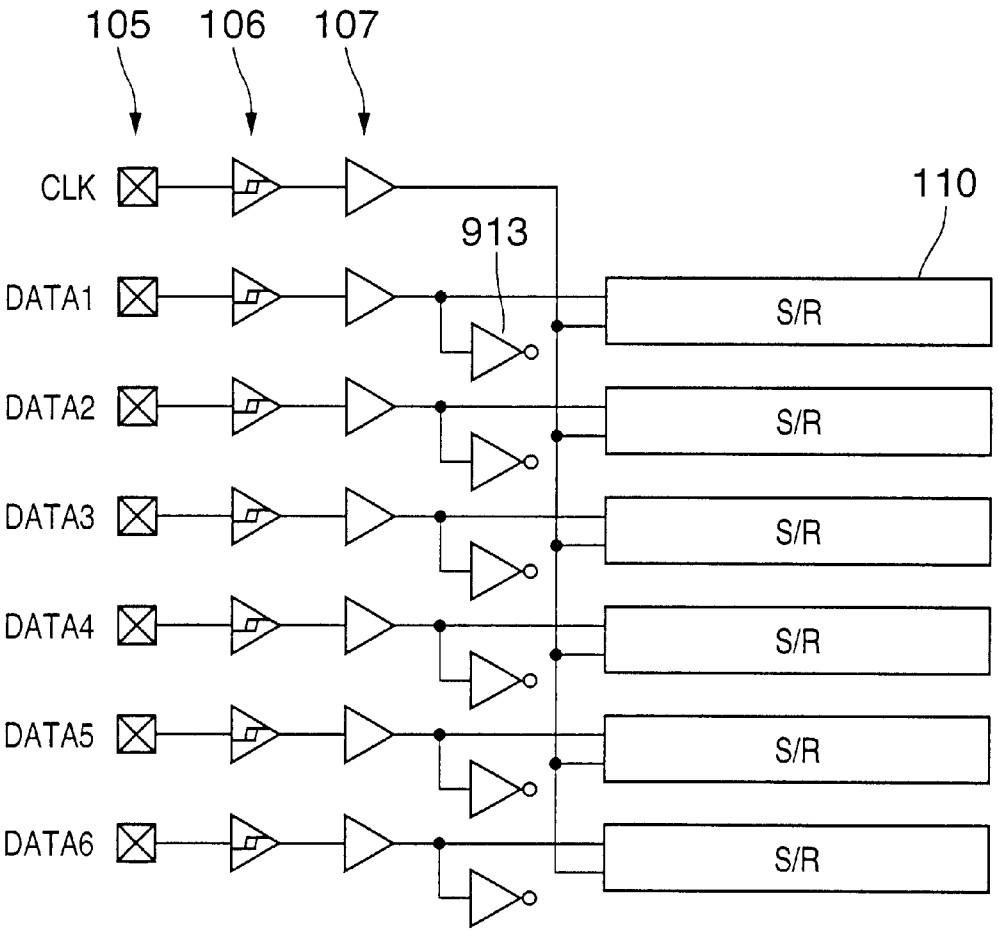
FIG. 12 is a circuit diagram showing wirings of DATA signal and CLK signal on a printhead substrate according to a fourth embodiment of the present invention.

FIG. 12 is a circuit diagram showing wirings of DATA signal and CLK signal on a printhead substrate according to the fourth embodiment of the present invention. Components that are common to those shown in FIGS. 9 and 10 are referred to by the same reference numerals, and descriptions thereof are omitted.

FIG. 12 shows that an inverter 913 is connected to each output of the buffer 107 of each DATA signal, as an example of the time lag adjuster 910. Assume that an input capacitance of each inverter 913 is CL. This case is similar to that of the second embodiment. The size of the inverter is set so that the input capacitance CL of each inverter satisfies the following:

$$CL=(n\times RCLK\times CCLK)/RDATA-CDATA$$

By virtue of this, a difference between the time lag of the DATA signal and the time lag of the CLK signal inputted to each shift register 110 can be eliminated.

[Fifth Embodiment]

Figure 13:
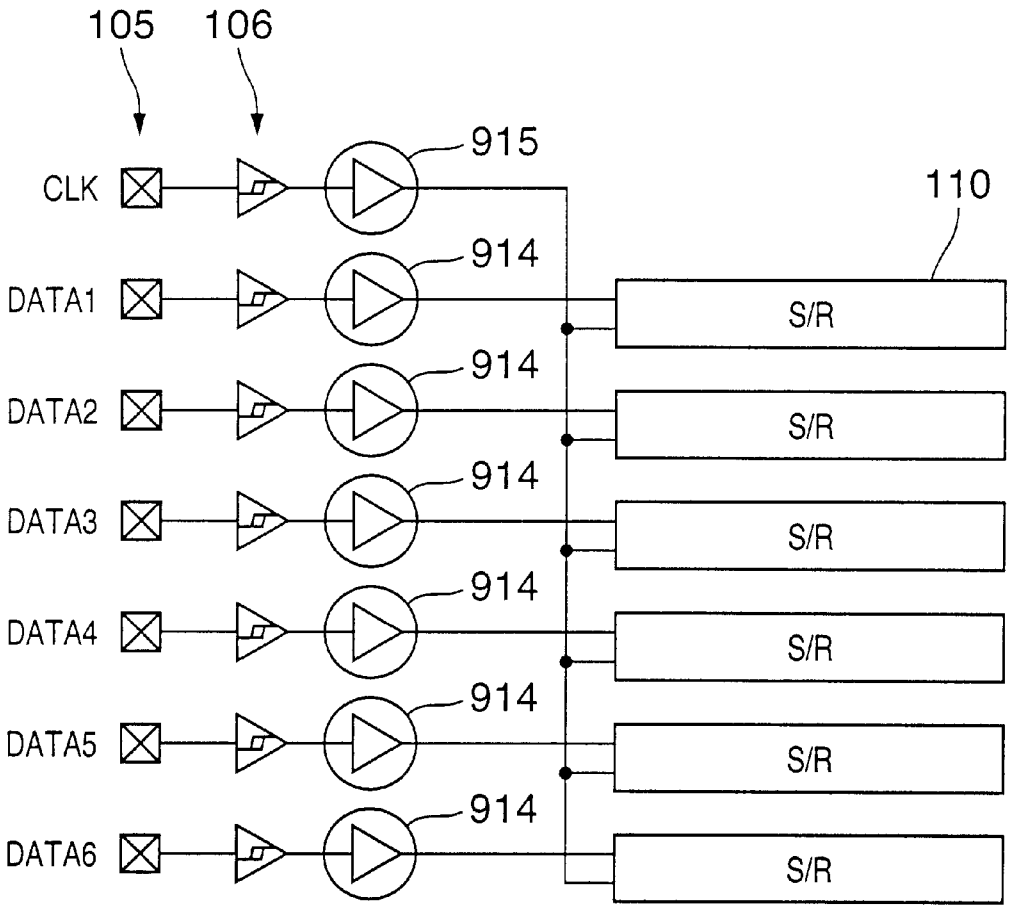
FIG. 13 is a circuit diagram showing wirings of DATA signal and CLK signal on a printhead substrate according to a fifth embodiment of the present invention.

FIG. 13 is a circuit diagram showing wirings of DATA signal and CLK signal on a printhead substrate according to the fifth embodiment of the present invention. Components that are common to those shown in FIGS. 9 and 10 are referred to by the same reference numerals, and descriptions thereof are omitted.

Herein, as an example of the time lag adjuster, assume that input capacitances at the DATA terminal and CLK terminal of each shift register 110 are CDATA and CCLK respectively. Further assume that on-resistances of the DATA signal and CLK signal at the time of driving the buffers circuits 914 and 915 are RDATA and RCLK respectively, and the number of shift registers 110 commonly connected to the CLK signal is n. Herein, the time lags TDATA and TCLK in each shift register are described as follows:

$$TDATA\approx RDATA\times CDATA$$

$$TCLK\approx n\times RCLK\times CCLK$$

Herein, the buffers circuits 914 and 915 of the DATA signal and CLK signal are set so as to satisfy the following:

$$RDATA\times CDATA=n\times RCLK\times CCLK$$

By virtue of this, a difference between the time lag of the DATA signal and the time lag of the CLK signal inputted to each shift register 110 can be eliminated.

[Sixth Embodiment]

Figure 14:
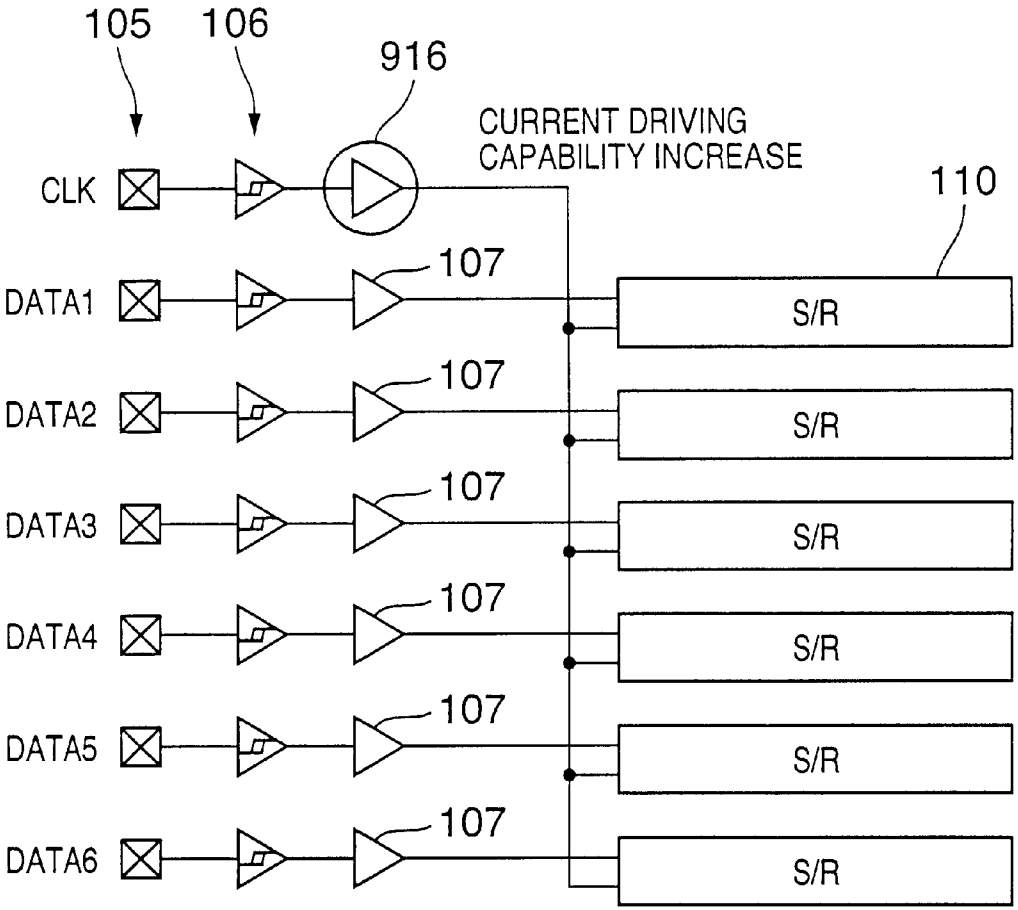
FIG. 14 is a circuit diagram showing wirings of DATA signal and CLK signal on a printhead substrate according to a sixth embodiment of the present invention.

FIG. 14 is a circuit diagram showing wirings of DATA signal and CLK signal on a printhead substrate according to the sixth embodiment of the present invention. Components that are common to those shown in FIGS. 9 and 10 are referred to by the same reference numerals, and descriptions thereof are omitted.

In this embodiment, a buffer circuit 916 serving as a time lag adjuster is provided only for a CLK signal, and a DATA signal is outputted through the buffer circuit 107 as conventionally is.

Herein, the buffer circuit 916 contributes to make the current driving capability of the clock signal CLK higher than the current driving capability of the buffer circuit 107 for the DATA signal.

By the foregoing manner, the current driving capability of the CLK signal is increased to compensate the time lag of the CLK signal with respect to the DATA signal. Accordingly, data transfer to the shift registers 110 is assured.

As described above, according to the foregoing embodiments, a difference between the time lag of the data signal and the time lag of the clock signal in a printhead substrate constituting a printhead is reduced to ensure inputting and storing of a data signal DATA performed in synchronization with the clock signal CLK. Accordingly, it is possible to reliably input and store data to a shift register at high speed with low power consumption.

Next, an inkjet printer according to an embodiment of the present invention is described by providing an example of an inkjet printer employing the above-described printhead (inkjet head).

Note in this embodiment, "recording" (or "printing") expresses not only a case of forming significant information such as characters or graphics or the like, but also a case of forming images, designs, patterns and so forth on a recording medium in a broad sense, or a case of processing a medium, irrespective of whether the information is significant or insignificant, or whether or not the information is manifested so as to be visually perceptible by humans.

Furthermore, a "printing medium" indicates not only paper used in general printers, but also fabric, plastic film, metal plate, glass, ceramic, wood, leather and so forth which can receive ink.

Furthermore, "ink" (or "liquid") should be interpreted broadly as in the above definition of "recording" (or "printing"). "Ink" indicates liquid that can be used to form images, designs, patterns and so forth or to process a printing medium by being applied to the printing medium, or to process ink (e.g., to solidify or insolubilize a coloring agent of the ink applied to a printing medium).

<Brief Description of Apparatus Main Unit>

Figure 15:
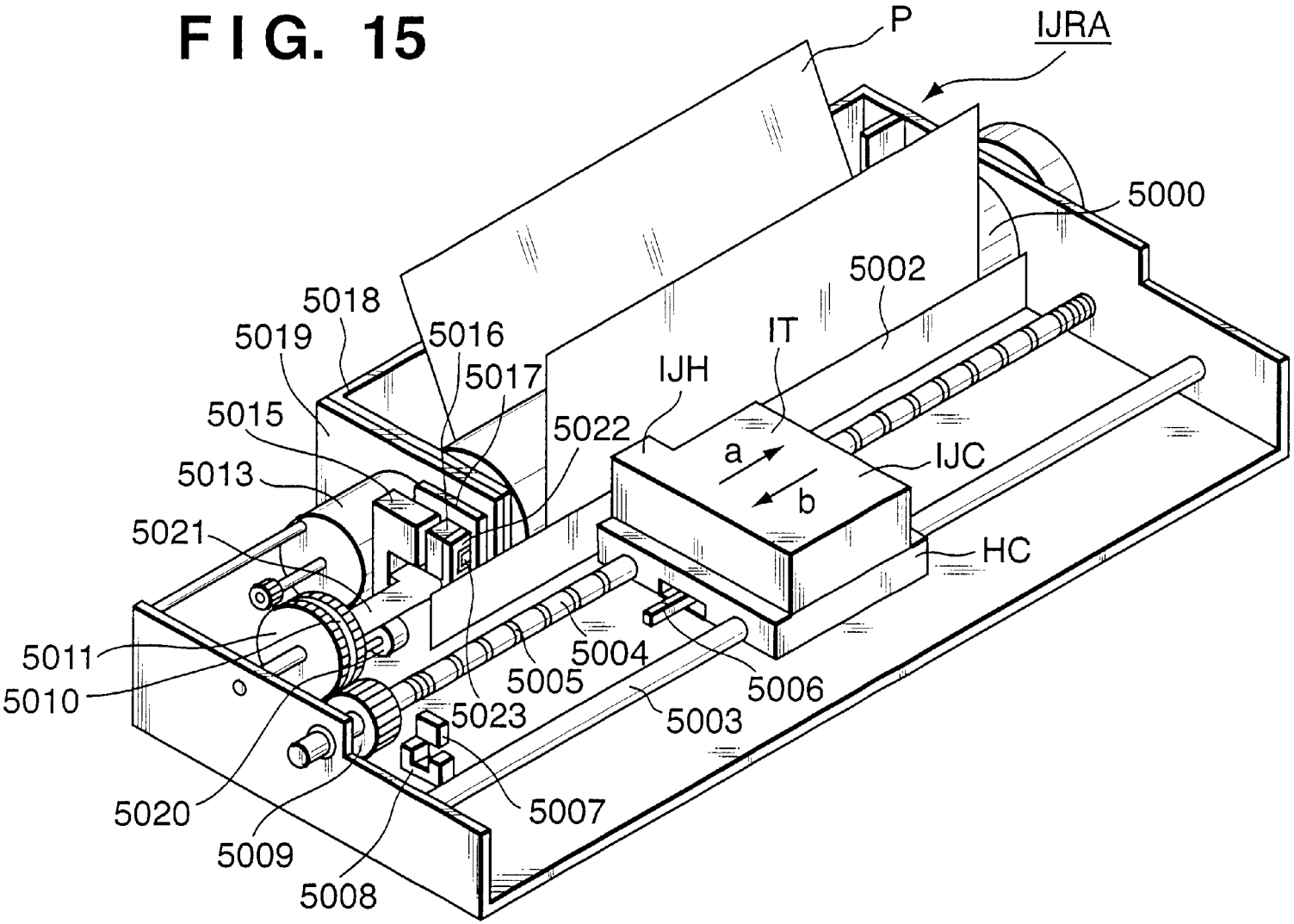
FIG. 15 is a perspective view showing the outer appearance of an inkjet printer IJRA as a typical embodiment of the present invention.

FIG. 15 is a perspective view showing the outer appearance of an inkjet printer IJRA as a typical embodiment of the present invention.

Referring to FIG. 15, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b while being supported by a guide rail 5003. An integrated-type inkjet cartridge IJC, which incorporates a printhead IJH having the above-described printhead substrate and an ink tank IT, is mounted on the carriage HC. Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printhead IJH; and 5015, a suction device for sucking ink residue through the interior of the cap member. The suction device 5015 performs suction recovery of the printhead via an opening 5023 of the cap member 5015. Reference numeral 5017 denotes a cleaning blade; 5019, a member which allows the blade to be movable in the back-and-forth direction of the blade. These members are supported by a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

<Description of Control Structure>

Next, a control structure for controlling recording operation of the above-described apparatus is described.

Figure 16:
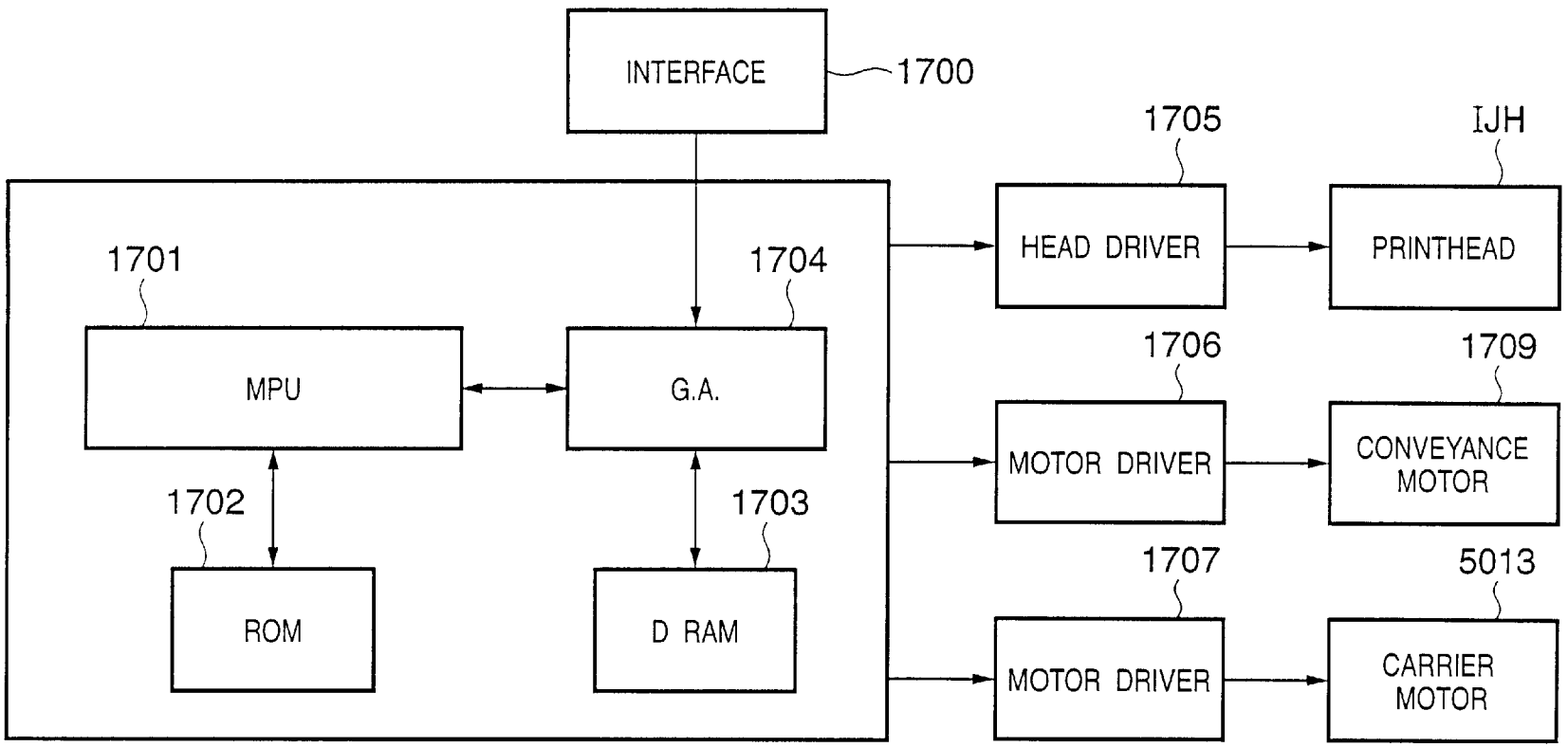
FIG. 16 is a block diagram showing an arrangement of functions of the inkjet printer shown in FIG. 15.

FIG. 16 is a block diagram showing an arrangement of a control circuit of the inkjet printer IJRA shown in FIG. 15.

Referring to FIG. 16 showing the control circuit, reference numeral 1700 denotes an interface for inputting a printing signal, numeral 1701 denotes an MPU, numeral 1702 denotes ROM storing a control program executed by the MPU 1701, and numeral 1703 denotes DRAM storing various data (aforementioned printing signal or printing data or the like, supplied to the printhead). Reference numeral 1704 denotes a gate array (G.A.) for performing supply control of printing data to the printhead IJH. The gate array 1704 also performs data transfer control among the interface 1700, MPU 1701, and RAM 1703. Reference numeral 5013 denotes a carrier motor for carrying the printhead IJH, and numeral 1709 denotes a conveyance motor for conveying a printing sheet. Reference numeral 1705 denotes a head driver for driving the printhead, and numerals 1706 and 1707 denote motor drivers for driving the conveyance motor 1709 and the carrier motor 5013.

The operation of the aforementioned control structure is now described. When a printing signal is inputted to the interface 1700, the printing signal is converted to printing data by the gate array 1704 and MPU 1701 intercommunicating with each other. As the motor drivers 1706 and 1707 are driven, the printhead is driven in accordance with the printing data transferred to the head driver 1705, thereby performing printing.

Herein, although the control program executed by the MPU 1701 is stored in the ROM 1702, an erasable/writable storage medium, e.g., EEPROM or the like, may be additionally provided to enable a host computer connected to the inkjet printer IJRA to change the control program.

Note that although the ink tank IT and printhead IJH may be integrally formed to constitute the exchangeable ink cartridge IJC as described above, the ink tank IT and printhead IJH may be made separable so as to enable an exchange of only the ink tank IT when ink is exhausted.

<Description of Ink Cartridge>

Figure 17:
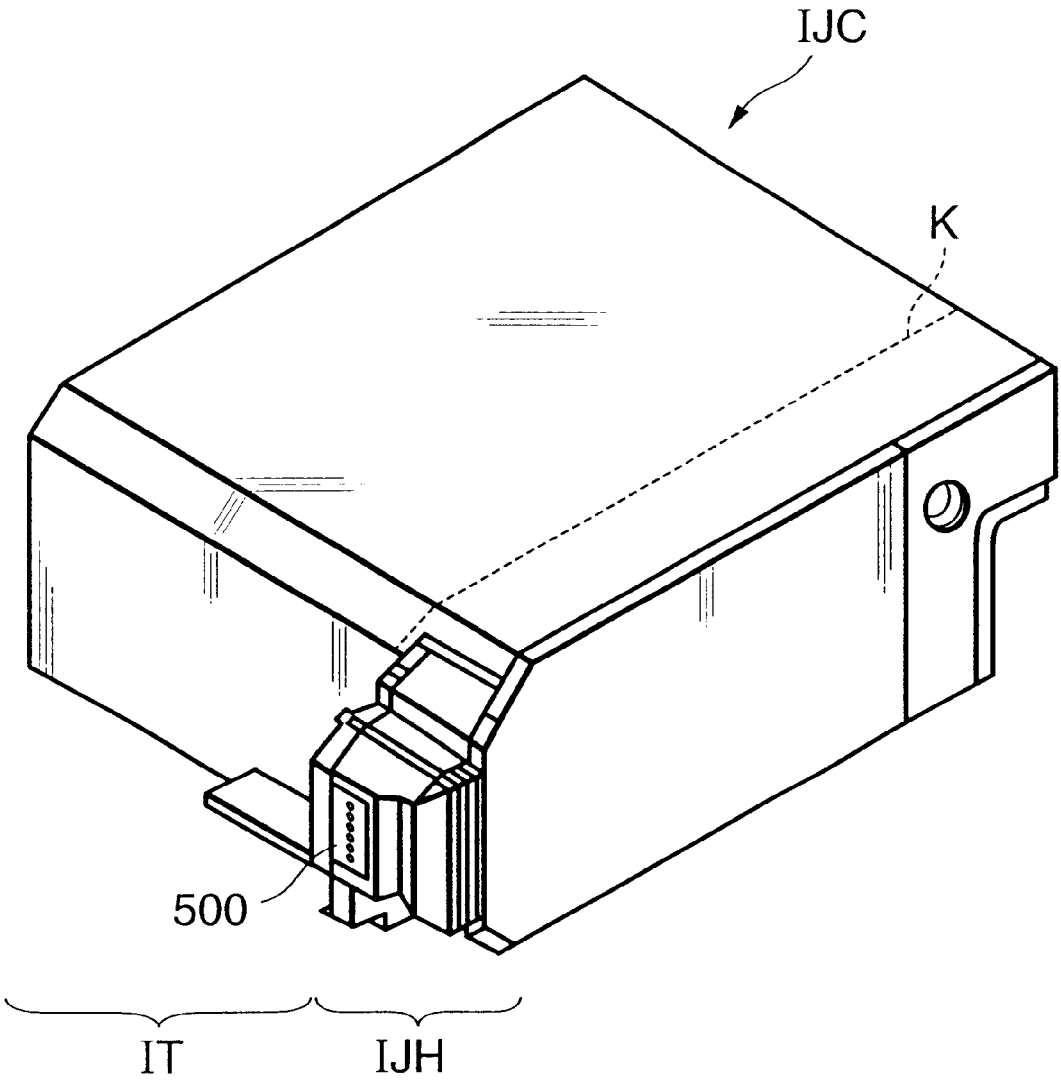
FIG. 17 is a perspective view showing the outer appearance of an ink cartridge IJC where an ink tank and printhead are separable.
Figure 18:
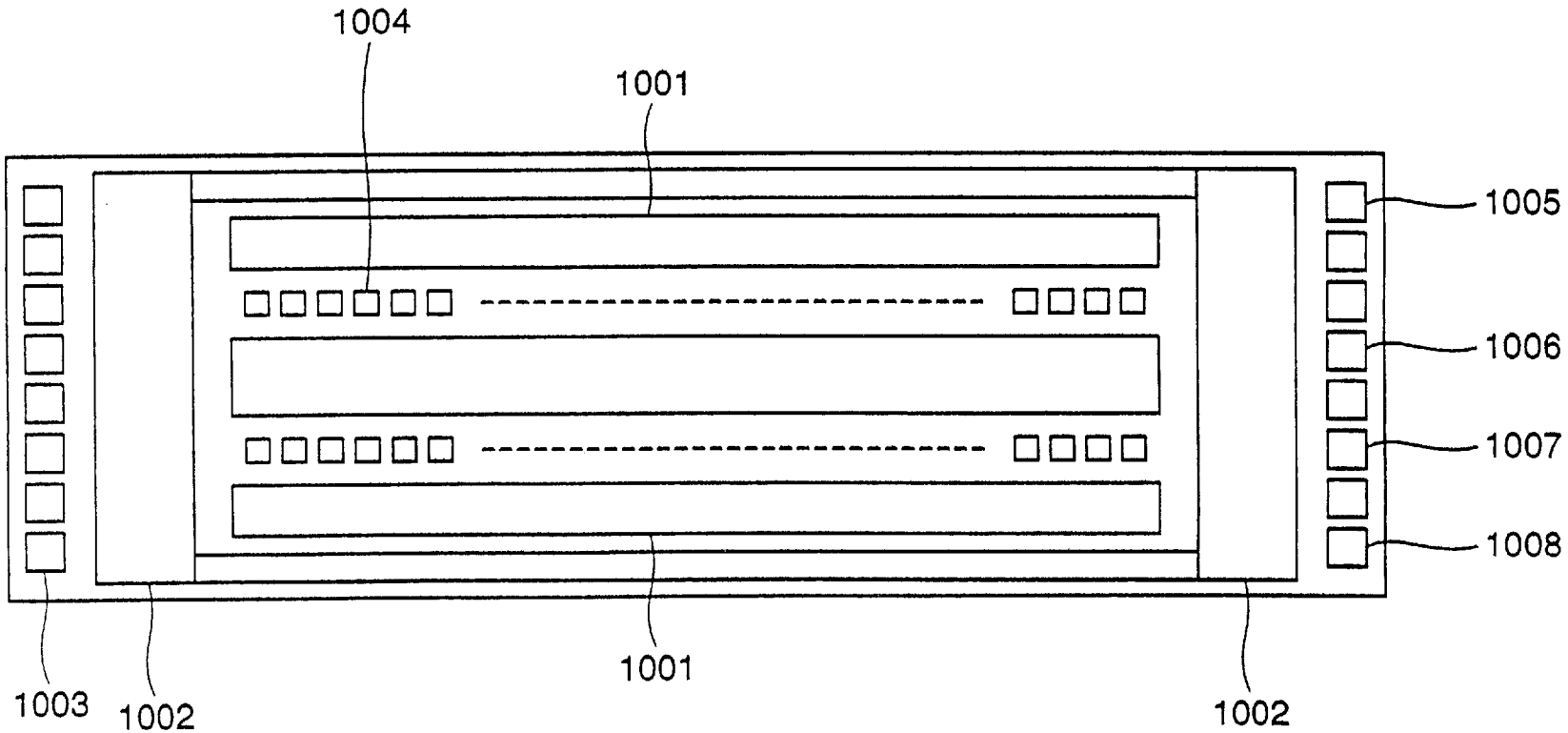
PRIOR ART FIG. 18
FIG. 18 is a view showing a layout of a conventional inkjet printhead substrate.
Figure 19:
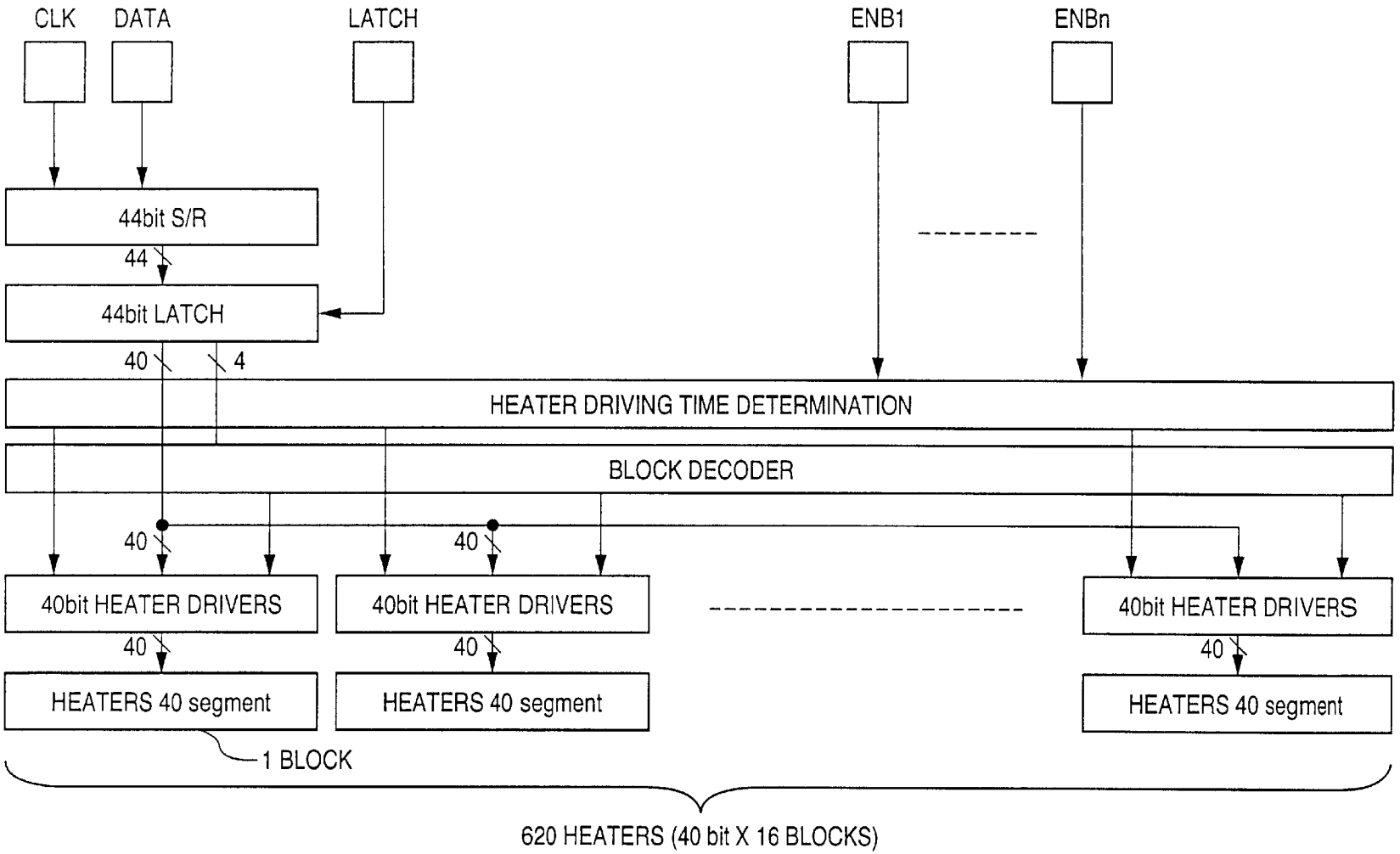
FIG. 19 is a block diagram of an inkjet printhead substrate.
Figure 20:
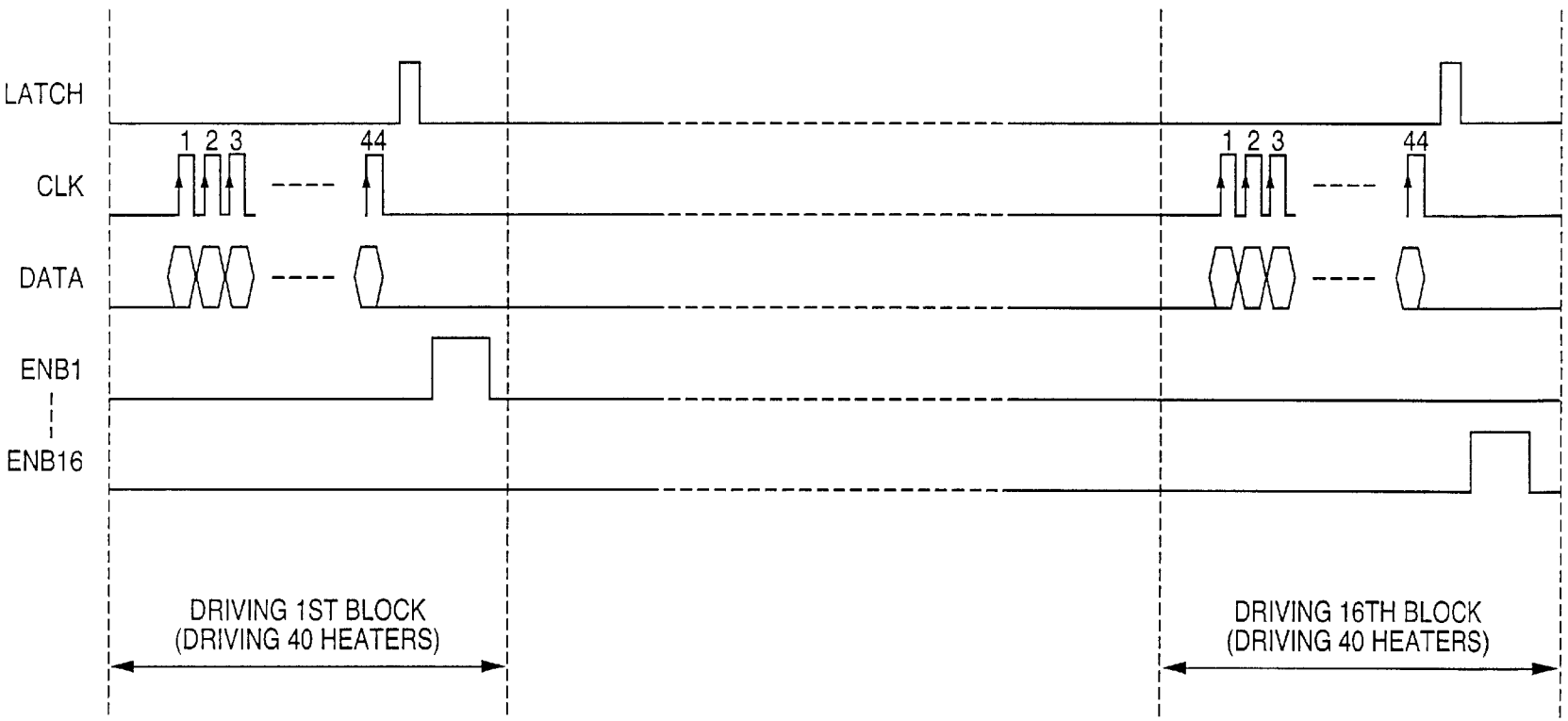
FIG. 20 is an example of driving timing of an inkjet printhead substrate.
Figure 21A:
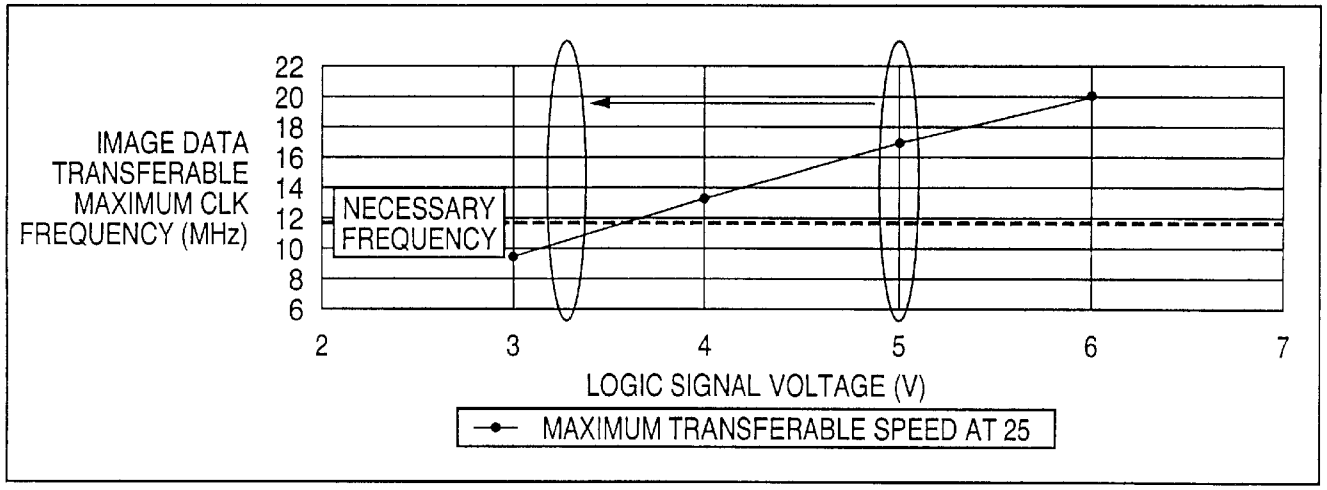
FIGS. 21A and 21B are views showing an image data transferable maximum CLK frequency in relation to a logic power-supply voltage.
Figure 21B:
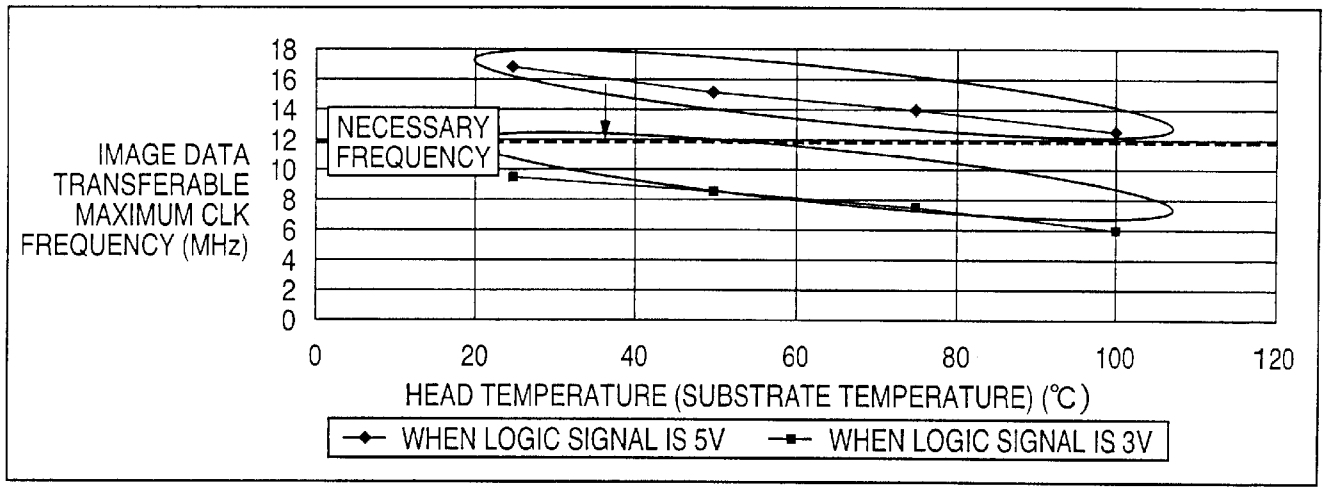

FIG. 17 is a perspective view showing the outer appearance of an ink cartridge IJC where the ink tank and printhead are separable. The ink tank IT can be separated from the printhead IJH at the boundary line K as shown in FIG. 17. The ink cartridge IJC includes electrodes (not shown) for receiving electrical signals from the carriage HC when mounted on the carriage HC. The printhead IJH is driven by the electrical signals as described above to discharge ink.

Note in FIG. 17, reference numeral 500 denotes an array of ink discharge orifices. The ink tank IT includes a fibrous or porous ink absorber for holding ink.

Note that in the foregoing embodiments, although the descriptions have been provided based on the assumption that a droplet discharged by the printhead is ink and that the liquid contained in the ink tank is ink, the contents are not limited to ink. For instance, the ink tank may contain processed liquid or the like, which is discharged to a print medium in order to improve image quality of a printed image, or to improve fixability or water resistance of the printed image.

[Other Embodiments]

Each of the embodiments described above comprises means (e.g., an electrothermal transducer, laser beam generator, and the like) for generating heat energy as energy utilized upon execution of ink discharge, and adopts the method which causes a change in state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, in place of the aforementioned serial type printhead which performs printing by scanning the printhead, the printhead according to the present invention may be of a full line type printhead having a length corresponding to the width of a maximum printing medium which can be printed by the printer. In this case, the printhead may adopt either the arrangement which satisfies the full-line length by combining a plurality of printhead substrates, or the arrangement of an integrally formed single printhead.

In addition, the present invention may employ not only the cartridge type printhead in which an ink tank is integrally arranged on the printhead itself as described in the foregoing embodiments, but also an exchangeable chip type printhead which can be electrically connected to the apparatus main unit and can receive ink from the apparatus main unit upon being mounted on the apparatus main unit.

It is preferable to add recovery means for the printhead, preliminary auxiliary means and the like to the arrangement of the above-described printer since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which begins to liquefy by application of heat energy, such as ink which liquefies upon application of heat energy according to a printing signal and is discharged in a liquid state, or ink which begins to solidify when it reaches a printing medium, or the like, is applicable to the present invention.

In addition, the printer of the present invention may be used in the form of a copying machine combined with a reader or the like, or a facsimile apparatus having a transmission/reception function, in addition to an integrally-provided or stand-alone image output terminal of an information processing equipment such as a computer.

The present invention is not limited to the above embodiments and various changes and modifications can be made within the spirit and scope of the present invention. Therefore, to apprise the public of the scope of the present invention, the following claims are made.

What is claimed is:

1. A printhead substrate inputting a data signal in synchronization with a clock signal, comprising:

a plurality of printing elements;

input terminals adapted to input the clock signal and the data signal;

a register adapted to input the clock signal and the data signal inputted from said input terminals, and latch the data signal in synchronization with the clock signal;

a time lag adjusting circuit adapted to be arranged between at least one of said input terminals and an input of said register to adjust a relative relation of transitional timings of the clock signal and the data signal by adjusting a time lag of at least one of the clock signal or the data signal; and a driver circuit adapted to drive said plurality of printing elements based on the data signal latched in said register.

2. The printhead substrate according to claim 1, wherein said time lag adjusting circuit adjusts the time lag so as to ensure setup time and hold time between the clock signal and the data signal inputted to said register from the input terminals.

3. The printhead substrate according to claim 2, wherein a plurality of registers are provided in accordance with a number of the data signal, and the clock signal is commonly inputted to said plurality of registers from the input terminal.

4. The printhead substrate according to claim 3, wherein said time lag adjusting circuit includes a capacitor component, having a predetermined capacitance, which is arranged to delay the data signal inputted from the input terminal by a predetermined time period.

5. The printhead substrate according to claim 3, wherein said time lag adjusting circuit includes a resistance component, having a predetermined resistance value, which is arranged to delay the data signal inputted from the input terminal by a predetermined time period.

6. The printhead substrate according to claim 3, wherein said time lag adjusting circuit includes an inverter circuit arranged to delay the data signal inputted from said input terminal by a predetermined time period.

7. The printhead substrate according to claim 3, wherein said time lag adjusting circuit includes a buffer circuit adapted to delay the data signal inputted from the input terminal by a predetermined time period.

8. The printhead substrate according to claim 3, wherein said time lag adjusting circuit includes a circuit, adapted to input the clock signal inputted from the input terminal, and increase a current driving capability of the clock signal higher than the data signal.

9. The printhead substrate according to claim 1, wherein said time lag adjusting circuit adjusts a phase of at least one of the clock signal and the data signal.

10. A printhead comprising:

a plurality of printing elements;

input terminals adapted to input a clock signal and a data signal;

a register adapted to input the clock signal and the data signal inputted from said input terminals, and latch the data signal in synchronization with the clock signal;

a time lag adjusting circuit adapted to be arranged between at least one of the input terminals and an input of said register to adjust a relative relation of transitional timings of the clock signal and the data signal by adjusting a time lag of at least one of the clock signal or the data signal; and a driver circuit adapted to drive said plurality of printing elements based on the data signal latched in said register.

11. The printhead according to claim 10, wherein said time lag adjusting circuit adjusts the time lag so as to ensure setup time and hold time between the clock signal and the data signal inputted to said register from the input terminals.

12. The printhead according to claim 11, wherein said printhead is an inkjet printhead which performs printing by using each of the plurality of printing elements to discharge ink.

13. The printhead according to claim 12, wherein each of the plurality of printing elements includes an electrothermal transducer for generating heat energy necessary to discharge ink.

14. The printhead according to claim 10, wherein said time lag adjusting circuit adjusts a phase of at least one of the clock signal and the data signal.

15. A printhead cartridge comprising:

a plurality of printing elements;

input terminals adapted to input a clock signal and a data signal;

a register adapted to input the clock signal and the data signal inputted from said input terminals, and latch the data signal in synchronization with the clock signal;

a time lag adjusting circuit adapted to be arranged between at least one of the input terminals and an input of said register to adjust a relative relation of transitional timings of the clock signal and the data signal by adjusting a time lag of at least one of the clock signal or the data signal;

a driver circuit adapted to drive said plurality of printing elements based on the data signal latched in said register; and an ink tank adapted to contain ink to be supplied to said plurality of printing elements.

16. The printer according to claim 15, wherein said time lag adjusting circuit adjusts a phase of at least one of the clock signal and the data signal.

17. A printer comprising:

a printhead including:

a plurality of printing elements;

input terminals adapted to input a clock signal and a data signal;

a register adapted to input the clock signal and the data signal inputted from the input terminals, and latch the data signal in synchronization with the clock signal;

a time lag adjusting circuit adapted to be arranged between at least one of the input terminals and an input of the register to adjust a relative relation of transitional timings of the clock signal and the data signal by adjusting a time lag of at least one of the clock signal or the data signal; and a driver circuit adapted to drive the plurality of printing elements based on the data signal latched in said register;

an ink tank adapted to contain ink to be supplied to the plurality of printing elements;

input means for inputting image data from an external apparatus; and data supply means for generating the data signal based on image data inputted by said input means, and supply the data signal to said printhead.

18. The printer according to claim 17, wherein said time lag adjusting circuit adjusts a phase of at least one of the clock signal and the data signal.

19. A printer comprising a head cartridge including:

a plurality of printing elements;

input terminals adapted to input a clock signal and a data signal;

a register adapted to input the clock signal and data inputted from the input terminals and latch the data signal in synchronization with the clock signal;

a time lag adjusting circuit adapted to be arranged between at least one of the input terminals and an input of the register to adjust a relative relation of transitional timings of the clock signal and the data signal by adjusting a time lag of at least one of the clock signal or the data signal;

a driver circuit adapted to drive the plurality of printing elements based on the data signal latched in said register; and an ink tank adapted to contain ink to be supplied to the plurality of printing elements;

input means for inputting image data from an external apparatus; and data supply means for generating the data signal based on image data inputted by said input means, and supply the data signal to signal head cartridge.

20. The printer according to claim 19, wherein said time lag adjusting circuit adjusts a phase of at least one of the clock signal and the data signal.

* * * * *

UNITED STATES PATENT AND TRADEMARK OFFICE

CERTIFICATE OF CORRECTION

PATENT NO. : 6,742,874 B2
DATED : June 1, 2004
INVENTOR(S) : Nobuyuki Hirayama et al.

It is certified that error appears in the above-identified patent and that said Letters Patent is hereby corrected as shown below:

Column 15,
Line 8, “the printer” should read -- The printhead cartridge --.

Signed and Sealed this

Seventh Day of September, 2004

JON W. DUDAS
*Director of the United States Patent and Trademark Office*